US007424760B2

(12) United States Patent
Chaffee

(10) Patent No.: US 7,424,760 B2
(45) Date of Patent: Sep. 16, 2008

(54) BODY SUPPORT, COMFORT DEVICE

(76) Inventor: Robert B. Chaffee, 78 Montgomery St., Boston, MA (US) 02116

( * ) Notice: Subject to any disclaimer, the term of this patent is extended or adjusted under 35 U.S.C. 154(b) by 27 days.

(21) Appl. No.: 11/090,514

(22) Filed: Mar. 25, 2005

(65) Prior Publication Data

US 2005/0166326 A1 Aug. 4, 2005

Related U.S. Application Data

(63) Continuation-in-part of application No. 10/412,075, filed on Apr. 11, 2003, now Pat. No. 7,000,276.

(60) Provisional application No. 60/556,749, filed on Mar. 26, 2004.

(51) Int. Cl.
*A47C 27/00* (2006.01)

(52) U.S. Cl. ..... 5/644; 5/654; 5/655.3; 5/655.9; 5/710

(58) Field of Classification Search ..... 5/644, 5/654, 655.3, 655.9, 706, 710
See application file for complete search history.

(56) References Cited

U.S. PATENT DOCUMENTS

| | | | | |
|---|---|---|---|---|
| 388,037 | A | | 8/1888 | Hargin |
| 633,968 | A | | 9/1899 | Swartzwelder |
| 918,391 | A | | 4/1909 | Taarud |
| 934,465 | A | | 9/1909 | Rust |
| 1,282,980 | A | | 10/1918 | Takach |
| 1,361,453 | A | | 12/1920 | Frey |
| 1,576,211 | A | | 3/1926 | O'Kane |
| 1,944,466 | A | | 1/1934 | Rubin |
| 2,028,060 | A | | 1/1936 | Gilbert |
| 2,369,736 | A | | 2/1945 | Hurt |
| 2,372,218 | A | | 3/1945 | Manson et al. |
| 2,415,150 | A | | 2/1947 | Stein |
| 2,434,641 | A | * | 1/1948 | Burns ..... 267/117 |
| 2,549,597 | A | | 4/1951 | Harris |
| 2,575,764 | A | | 11/1951 | Morner |
| 2,604,641 | A | | 7/1952 | Reed |
| D167,871 | S | | 9/1952 | Vega |
| 2,614,272 | A | | 10/1952 | Morner |
| 2,672,628 | A | | 3/1954 | Spanel |
| 2,741,780 | A | | 4/1956 | Kimbrig |
| 2,823,668 | A | | 2/1958 | Van Court et al. |
| 2,842,783 | A | | 7/1958 | Druck |

(Continued)

FOREIGN PATENT DOCUMENTS

DE 4000629 A1 7/1990

(Continued)

*Primary Examiner*—Michael Trettel
(74) *Attorney, Agent, or Firm*—Lowrie, Lando & Anastasi, LLP.

(57) ABSTRACT

The invention relates to a body support and comfort device. The device comprises an inflatable bladder having a shape and size to substantially cover at least one support surface of a body support device so as to conform to and provide a comfort and support layer to the body support device. The body support and comfort device also includes at least one comfort layer shaped and arranged to substantially cover a surface of the inflatable bladder that is to interact with a user. According to one embodiment, a self-sealing valve is coupled to a port of the inflatable bladder, and is constructed and arranged to enable all of inflation, deflation, and comfort of the surface comfort device.

40 Claims, 17 Drawing Sheets

U.S. PATENT DOCUMENTS

| | | | | |
|---|---|---|---|---|
| 2,853,720 | A | 9/1958 | Friedlander | |
| 3,008,214 | A | 11/1961 | Foster et al. | |
| 3,042,941 | A | 7/1962 | Marcus | |
| 3,128,480 | A | 4/1964 | Lineback | |
| 3,155,991 | A | 11/1964 | Dunham | |
| 3,164,151 | A | 1/1965 | Vere Nicoll | |
| 3,274,624 | A | 9/1966 | Noerdinger | |
| 3,283,343 | A | 11/1966 | Worcester | |
| 3,296,635 | A | 1/1967 | O'Hanlan | |
| 3,298,044 | A * | 1/1967 | Saltness et al. | 5/644 |
| 3,312,987 | A * | 4/1967 | Emery | 5/644 |
| 3,424,151 | A | 1/1969 | Ericson | |
| 3,462,775 | A | 8/1969 | Markwitz et al. | |
| 3,505,695 | A | 4/1970 | Bishaf et al. | |
| 3,561,435 | A | 2/1971 | Nicholson | |
| D220,953 | S | 6/1971 | Pres | |
| 3,610,235 | A | 10/1971 | Vagacs | |
| 3,653,084 | A | 4/1972 | Hartman | |
| 3,772,717 | A | 11/1973 | Yuen et al. | |
| 3,790,975 | A | 2/1974 | Phillip et al. | |
| 3,798,686 | A | 3/1974 | Gaiser | |
| 3,813,716 | A | 6/1974 | Francis | |
| 3,829,918 | A | 8/1974 | Stamberger | |
| 3,840,922 | A | 10/1974 | Morrison et al. | |
| 3,864,766 | A | 2/1975 | Prete, Jr. | |
| 3,877,092 | A | 4/1975 | Gaiser | |
| 3,898,703 | A | 8/1975 | Stamberger | |
| 3,899,797 | A | 8/1975 | Gunst | |
| 3,938,569 | A | 2/1976 | Hill | |
| 4,025,974 | A | 5/1977 | Lea et al. | |
| 4,091,482 | A | 5/1978 | Malcolm | |
| 4,099,773 | A | 7/1978 | Chang | |
| 4,149,285 | A | 4/1979 | Stanton | |
| 4,168,063 | A | 9/1979 | Rowland | |
| 4,169,295 | A | 10/1979 | Darling | |
| 4,175,297 | A | 11/1979 | Robbins et al. | |
| D253,983 | S | 1/1980 | McRight | |
| 4,266,298 | A | 5/1981 | Graziano | |
| 4,300,759 | A | 11/1981 | Caplan | |
| 4,317,244 | A | 3/1982 | Balfour-Richie | |
| 4,348,779 | A | 9/1982 | Leber | |
| 4,371,999 | A | 2/1983 | Reid | |
| 4,405,129 | A | 9/1983 | Stuckey | |
| 4,528,705 | A | 7/1985 | Greenawalt | |
| 4,594,743 | A | 6/1986 | Owen et al. | |
| 4,644,597 | A | 2/1987 | Walker | |
| 4,768,247 | A | 9/1988 | Beier | |
| 4,807,313 | A | 2/1989 | Ryder et al. | |
| 4,807,554 | A | 2/1989 | Chi-Hung | |
| 4,829,614 | A | 5/1989 | Harper et al. | |
| 4,862,533 | A | 9/1989 | Adams | |
| 4,890,344 | A | 1/1990 | Walker | |
| 4,896,389 | A | 1/1990 | Chamberland | |
| 4,905,332 | A | 3/1990 | Wang | |
| 4,964,183 | A | 10/1990 | LaForce, Jr. | |
| 4,970,741 | A | 11/1990 | Spina | |
| 4,977,633 | A | 12/1990 | Chaffee | |
| 4,982,466 | A | 1/1991 | Higgins et al. | |
| 4,986,738 | A | 1/1991 | Kawasaki et al. | |
| 4,999,074 | A | 3/1991 | Afeyan | |
| 5,044,030 | A | 9/1991 | Balaton | |
| 5,060,324 | A | 10/1991 | Marinberg et al. | |
| 5,068,933 | A | 12/1991 | Sexton | |
| 5,079,785 | A | 1/1992 | Garcia | |
| 5,085,214 | A | 2/1992 | Barrett | |
| 5,117,517 | A | 6/1992 | Su | |
| 5,163,196 | A | 11/1992 | Graebe et al. | |
| D335,999 | S | 6/1993 | Van Driessche | |
| 5,226,184 | A | 7/1993 | Cheng | |
| 5,243,722 | A | 9/1993 | Gusakov | |
| 5,267,363 | A | 12/1993 | Chaffee | |
| D343,980 | S | 2/1994 | Torchia | |
| 5,288,286 | A | 2/1994 | Davis | |
| 5,360,653 | A | 11/1994 | Ackley | |
| 5,367,726 | A | 11/1994 | Chaffee | |
| 5,450,858 | A | 9/1995 | Zablotsky et al. | |
| 5,474,361 | A | 12/1995 | Hwang et al. | |
| 5,493,742 | A | 2/1996 | Klearman | |
| 5,497,519 | A | 3/1996 | Mintz | |
| 5,509,154 | A | 4/1996 | Shafer et al. | |
| 5,513,402 | A | 5/1996 | Schwartz | |
| 5,562,484 | A | 10/1996 | Mlynarz et al. | |
| 5,598,593 | A | 2/1997 | Wolfe | |
| 5,606,756 | A | 3/1997 | Price | |
| 5,619,764 | A | 4/1997 | Lopau | |
| 5,638,565 | A | 6/1997 | Pekar | |
| 5,642,546 | A | 7/1997 | Shoenhair | |
| 5,689,845 | A | 11/1997 | Sobieralski | |
| 5,699,569 | A | 12/1997 | Schwarz-Zohrer | |
| 5,708,999 | A * | 1/1998 | Priolo et al. | 5/644 |
| D391,435 | S | 3/1998 | Song et al. | |
| 5,771,514 | A * | 6/1998 | Wilhoit | 5/644 |
| 5,839,139 | A | 11/1998 | Fink | |
| 5,845,352 | A | 12/1998 | Matsler et al. | |
| D405,636 | S | 2/1999 | Stewart | |
| 5,898,963 | A | 5/1999 | Larson | |
| 5,902,011 | A | 5/1999 | Hand et al. | |
| 5,903,941 | A | 5/1999 | Shafer et al. | |
| 5,904,172 | A | 5/1999 | Gifft et al. | |
| 5,947,563 | A | 9/1999 | Klimenko | |
| 5,951,111 | A | 9/1999 | Klimenko | |
| D414,976 | S | 10/1999 | Su et al. | |
| 5,960,495 | A | 10/1999 | Hsu et al. | |
| 5,963,997 | A | 10/1999 | Hagopian et al. | |
| 5,970,545 | A | 10/1999 | Garman et al. | |
| 6,012,188 | A | 1/2000 | Daniels et al. | |
| 6,037,723 | A | 3/2000 | Shafer et al. | |
| 6,047,425 | A * | 4/2000 | Khazaal | 5/644 |
| 6,076,214 | A | 6/2000 | Klimenko | |
| 6,102,759 | A | 8/2000 | Klimenko | |
| 6,129,524 | A | 10/2000 | Woollenweber et al. | |
| 6,131,219 | A * | 10/2000 | Roberts | 5/644 |
| 6,148,461 | A | 11/2000 | Cook et al. | |
| 6,152,530 | A | 11/2000 | Hsu et al. | |
| 6,163,907 | A | 12/2000 | Larson | |
| 6,189,168 | B1 | 2/2001 | Graebe | |
| 6,206,654 | B1 | 3/2001 | Cassidy | |
| 6,209,159 | B1 * | 4/2001 | Murphy | 5/654 |
| 6,212,718 | B1 | 4/2001 | Stolpmann et al. | |
| D441,586 | S | 5/2001 | Su | |
| 6,224,444 | B1 | 5/2001 | Klimenko | |
| 6,226,820 | B1 | 5/2001 | Navarro | |
| 6,237,621 | B1 | 5/2001 | Chaffee | |
| 6,237,653 | B1 | 5/2001 | Chaffee | |
| 6,240,584 | B1 | 6/2001 | Perez et al. | |
| D448,229 | S | 9/2001 | Su et al. | |
| 6,283,056 | B1 | 9/2001 | Tchaikovsky | |
| 6,286,167 | B1 | 9/2001 | Stolpmann | |
| 6,302,145 | B1 | 10/2001 | Ellis et al. | |
| 6,317,912 | B1 | 11/2001 | Graebe et al. | |
| 6,345,401 | B1 | 2/2002 | Frydman | |
| 6,397,417 | B1 | 6/2002 | Switlik | |
| 6,397,419 | B1 | 6/2002 | Mechache | |
| 6,439,264 | B1 | 8/2002 | Ellis et al. | |
| 6,446,289 | B1 | 9/2002 | Su et al. | |
| D464,225 | S | 10/2002 | Boso et al. | |
| 6,483,264 | B1 | 11/2002 | Shafer et al. | |
| 6,487,737 | B1 | 12/2002 | Futagami | |
| 6,532,962 | B1 | 3/2003 | Walker et al. | |
| 6,543,073 | B2 | 4/2003 | Wu | |
| 6,568,011 | B2 | 5/2003 | Fisher et al. | |
| 6,643,875 | B2 | 11/2003 | Boso et al. | |
| 6,701,559 | B2 | 3/2004 | Boso et al. | |
| 6,804,848 | B1 | 10/2004 | Rose | |

| | | | |
|---|---|---|---|
| 6,871,369 | B1 | 3/2005 | Long |
| 7,000,276 | B2 | 2/2006 | Chaffee |
| 2002/0050010 | A1 | 5/2002 | Shimada |
| 2002/0116765 | A1 | 8/2002 | Smith et al. |
| 2002/0184710 | A1 | 12/2002 | Chaffee |
| 2002/0194678 | A1 | 12/2002 | Chung |
| 2003/0028971 | A1 | 2/2003 | Chaffee |
| 2003/0066489 | A1 | 4/2003 | Whitehill |
| 2003/0192123 | A1 | 10/2003 | Chaffee |
| 2003/0200611 | A1 | 10/2003 | Chaffee |
| 2004/0107503 | A1 | 6/2004 | Tu |
| 2005/0000025 | A1 | 1/2005 | Metzger et al. |
| 2005/0166326 | A1 | 8/2005 | Chaffee |
| 2006/0253991 | A1 | 11/2006 | McClintock |

FOREIGN PATENT DOCUMENTS

| | | | |
|---|---|---|---|
| EP | 0786219 | A1 | 7/1997 |
| FR | 2721581 | A | 12/1995 |
| GB | 903557 | A | 8/1962 |
| GB | 1381952 | A | 1/1975 |
| GB | 2140294 | A | 11/1984 |
| GB | 2198341 | A | 6/1988 |
| WO | 0187121 | | 11/2001 |
| WO | 03093709 | | 1/2003 |
| WO | WO 03/086152 | A1 | 10/2003 |

* cited by examiner

BODY SUPPORT, COMFORT DEVICE

RELATED APPLICATIONS

This application is a non-provisional of and claims priority under 35 U.S.C. §119(e), to provisional application Ser. No. 60/556,749, filed Mar. 26, 2004, the entire contents of which are herein incorporated by reference, and is a continuation-in-part of application Ser. No. 10/412,075, filed Apr. 11, 2003 now U.S. Pat. No. 7,000,276, the entire contents of which are incorporated herein by reference.

FIELD OF THE INVENTION

The present invention relates to a layered, inflatable, body support and surface comfort device which may be used with body support devices or as a stand alone device.

DISCUSSION OF THE RELATED ART

It is to be understood that a body support structure or body support device, as used herein, includes, for example, a chair seat, a chair back, a head rest, a leg or foot support device, a recliner, a mattress, or any other structure or device that is used for, for example, sitting, reclining, lying down, or supporting a person. A body support structure or device may be beveled, contoured, angled, or some how shaped for, for example, sitting, reclining and the like. Such body support devices or structures may comprise a solid surface, a padded surface, an upholstered surface, and may also comprise any number of types of support structure, such as foam, springs, suspension straps, and the like.

It is often desirable to provide comfort and/or support layers to existing body support structures, such as chairs, car seats, mattresses, and the like. There have been a number of different products offered and sold in the marketplace that attempt to provide such comfort and support. For example, there are contoured foam and foam covered structures that can be used with a car seat. There are also wooden beaded structures that can be attached to the back of a car seat and purportedly provide support or comfort to a person sitting in the car seat. As another example, there are sporting event seats made of foam and other synthetic materials and typically encased in a flexible plastic covering, which can be, for example, placed on top of metal or wooden benches at a sporting activity. As another example, many automobiles are provided with a lumbar support that is built into a base of a back of the car seat that can be adjusted, typically by moving a lever or rotating a knob, to vary the amount of support and/or comfort provided by the lumbar support. As another example, a conventional mattress is sometimes used with an additional top layer commonly known as a mattress "topper". These are just some examples of comfort or support devices that have been used in the marketplace.

Some of these devices comprise a layer of foam which can be placed over the body support structure or device to provide a layer of comfort. The layer of foam may have a contour and may be surrounded or covered, for example, by an outer protective layer of plastic, fabric. One problem with these foam layer devices is that the foam layer must be thin to accommodate shaped devices, and foam is a compressible material which compacts at a point where pressure is applied. For example, by applying pressure to the thin foam layer, for example by sitting on the thin foam layer, a pressure point results from where the foam is compacted to the underlying body support device. Thus, the thin layer of foam typically does not equally distribute the applied pressure or weight and typically provides at least one pressure point and discomfort point to the user of the thin foam device. Another problem with foam devices is that the performance of foam degrades over time and can vary with environmental conditions.

Referring to FIG. 1, there is illustrated a thin foam device 100 may have in a thickness t of less than 2 inches and a surface 102 providing pressure on the thin foam device, which results in pressure points 104, 106, 108 and 109, as illustrated. As can be seen from FIG. 1, the pressure point 104 has a magnitude A which a represents pressure point of most pressure and pressure point 109 has a magnitude D which represents a pressure point of least pressure in a range A-D of magnitudes of pressure experienced with the thin foam layer. As can be seen from FIG. 1, the thin foam layer does not equally distribute the applied pressure and compacts to provide at least one area 111 with a pressure point 104 that may be uncomfortable. In addition, the thin foam device 100 does not supportively conform to a surface or subject applying pressure to the thin foam device. Further, the thin foam device may not typically conform to the body support device that it is used with.

Another example of surface comfort devices includes inflatable devices, including, inflatable pillows, inflatable rafts, inflatable mattresses, and the like. However, one problem with some inflatable devices is that they may not be self-sealing, thus requiring a user to act quickly with a valve when inflating the device. For example, many inflatable devices comprise stem-type valves that require removing a cover or mating piece to inflate the inflatable device, and then inserting the cover or mating piece to maintain the fluid within the inflatable device. These valves may not be self-sealing, thus requiring quick sealing on the part of the user. In addition, these valves typically have a small diameter and because of the small size are difficult to adjust an amount of fluid in the device. For example, a user must blow into the stem valve or use a pump with a small diameter configured to mate with the stem valve, then quickly insert the mating piece to maintain the fluid pressure.

Another problem with some inflatable devices is that the inflatable devices are not intended to be used with shaped or cushioned surfaces, and instead are intended to be used on a flat surface. For example, an inflatable mattress is used as a body support device itself, and is typically used on a floor or a flat surface. However, an inflatable mattress would not work well with and would not conform to a shaped surface.

For example, referring to FIGS. 2 and 3, there is illustrated an inflatable device 10 that is intended to be used on a flat surface such as a floor or a bench-type seat as a seat cushion. However, the problem with device 10 is that it is not sized or shaped to be ergonomically compatible with a shaped surface. Thus, the device 10 is typically not appropriate for use with the shaped body support structure. For example, the size of the device is not typically large enough to cover the entire surface 12 of the seat 13 of the chair 9 In addition, the device 10 is typically thick, such as for example greater than 2 inches in thickness, since it is intended to be used with a flat surface and to provide cushioning to a subject sitting on the device 10 placed on the flat surface. However, the thickness of the device and the size of the device make it impractical to be used with a shaped surface such as the surface 12 of the seat 13. In particular, the device 10 does not over spread the entire surface 12 and does not conform to the shape of the surface 12. In addition, when the device is not fully inflated, it tends to move around the surface 12 and provide an unbalanced cushioning. Thus, the device 10 is ergonomically incompatible with a shaped surface such as the surface 12 and does not overspread the entire surface 12, and can be unstable to use with a shaped surface. Further, the device 10 may not have a mechanism for easily adjusting an amount of fluid within the device 10, to adjust an amount of support or comfort that the device 10 provides. For example, the device may have a stem valve as discussed above which requires fumbling with the valve and the mating cover in order to inflate or adjust the amount of fluid in device 10, and therefore there is no easy adjustment mechanism to adjust the amount of fluid in the device 10.

SUMMARY

In view of the problems and disadvantages of the above described structures, there is a need for a device that can easily be adjusted to vary the level of comfort and support provided by the device, and that can be adaptable for use by a variety of users of different body types and sizes, to provide varying levels of comfort and support in a variety of user settings (used over a variety of body support devices, in a variety of locations). Further, there is a need for a device that conforms to a surface that applies pressure to the device.

According to one embodiment, there is provided a body support and comfort device that comprises an inflatable bladder. The inflatable bladder is sized and shaped to conform to a body support device and to provide a comfort layer to be used with the body support device. The support and comfort device also comprises a comfort layer shaped and arranged to substantially cover a surface of the inflatable bladder that is to interact with a user. In some embodiments, the support and comfort device further comprises a port through which inflation and deflation of the inflatable bladder is accomplished, and a self-sealing valve coupled to the port of the inflatable bladder, that is constructed and arranged to enable all of inflation, deflation and comfort control of the support and comfort device.

Some examples of this embodiment of the support and comfort device include a pillow and a mattress topper.

In some embodiments, the additional layer comprises foam, and in particular a memory foam.

In some embodiments, the inflatable bladder has a contoured shape. In some embodiments, the support and comfort device further comprises shape defining members that also provide the contoured shape.

In some embodiments, the inflatable bladder is shaped to be used as a pillow to provide comfort and support to a head of the user. In some embodiments, the pillow shape comprises a recessed area to support the head of the user. In some embodiments, the pillow shape comprises a perimeter area that is larger in cross section than the recessed area, and that is configured to provide support to a neck area of the user.

In some embodiments, the support and comfort device further comprises an attachment device, such as a strap, that secures the additional comfort layer to the inflatable bladder.

In some embodiments, the support and comfort device is shaped and sized to be used on top of a mattress to provide comfort and support to the user.

BRIEF DESCRIPTION OF THE DRAWINGS

Various features and aspects of embodiments will be apparent from the following non-limiting discussion, with reference to the accompanying figures. In the figures, in which like reference numerals represent like elements throughout the different figures.

DETAILED DESCRIPTION

It is to be understood that a body support structure or a body support device, as used herein, includes, for example, a chair seat, a chair back, a head rest, a leg or foot support device, a recliner, a mattress, or any other structure or device that is used for, for example, sitting, reclining, lying down, or otherwise supporting a person. A body support structure or device may be beveled, contoured, angled, or some how shaped for, for example, sitting, reclining, and the like, and also may be substantially flat, e.g., such as a mattress. Such body support devices or structures may comprise a solid surface, a padded surface, an upholstered surface, and may also comprise any number of types of support structure, such as foam, springs, suspension straps, and the like.

Figure 5:
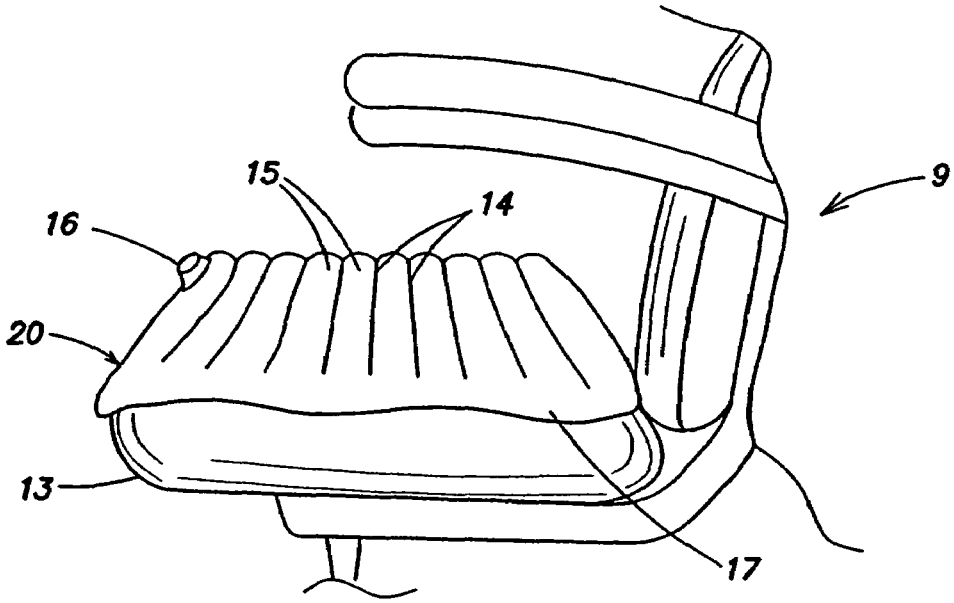
FIG. 5 is a side perspective view of one embodiment of a support and comfort device.
Figure 6:
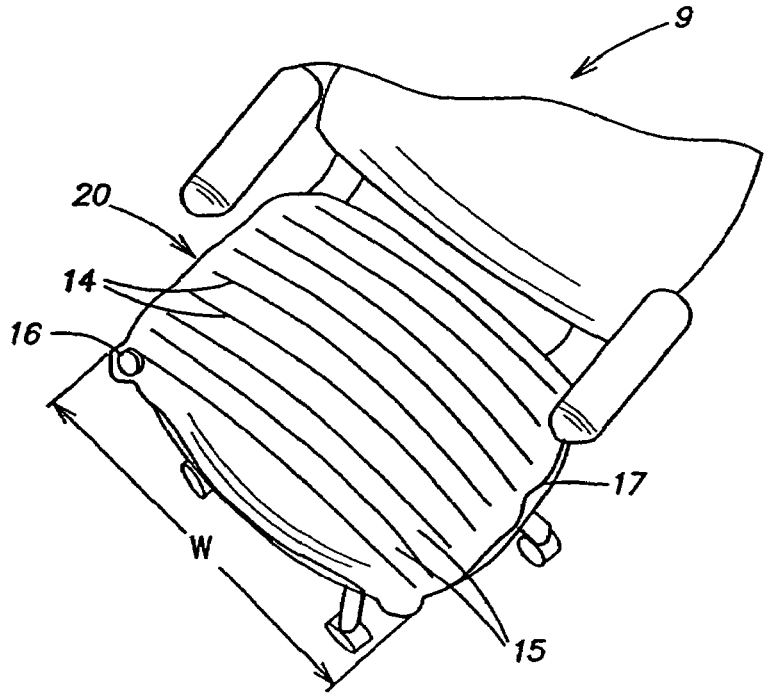
FIG. 6 is a top perspective view of the embodiment of support and comfort device of FIG. 5.

Referring to FIGS. 5-6 there is illustrated one embodiment of a self-sealing, inflatable support and comfort device 20. The support and comfort device 20 is an inflatable device that when at least partially inflated provides a conformable, flexible cushioning layer that may be used in combination with a shaped or cushioned body support device, such as for example, the shaped seat 13 of chair 9 as illustrated in FIGS. 5-6, so as to improve the comfort and/or support of the chair.

Figure 1:
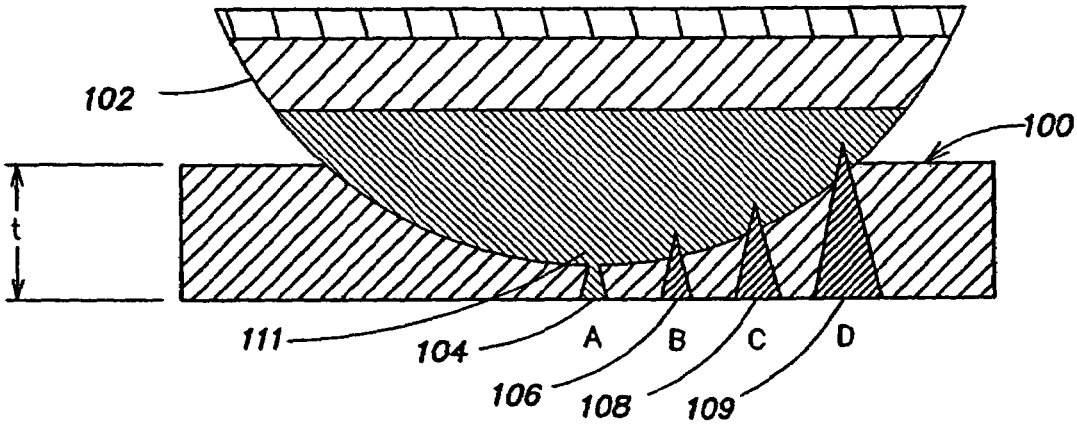
FIG. 1 (PRIOR ART)
FIG. 1 illustrates a thin foam layer of related art surface comfort devices and their inability to equally distribute applied pressure.
Figure 4:
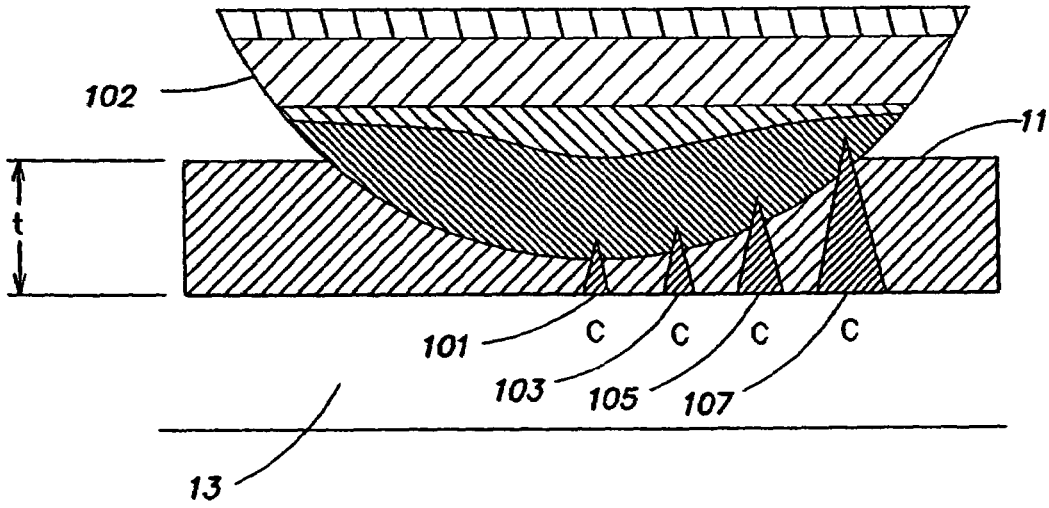
FIG. 4 illustrates how a comfort device comprising an inflatable device can equally distribute applied pressure.
Figure 2:
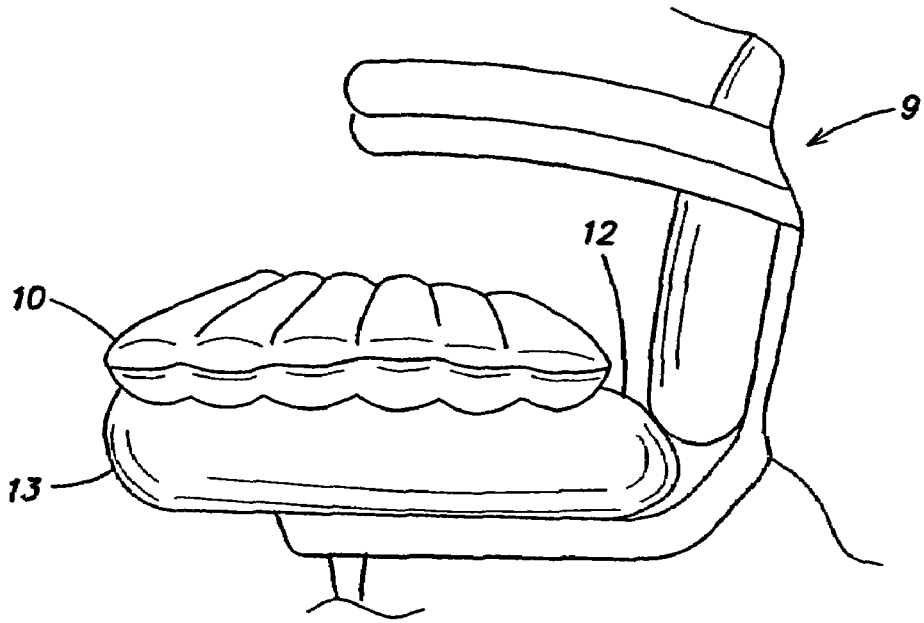
FIG. 2 (PRIOR ART)
FIG. 2 is a side perspective view of an inflatable surface comfort device typically used with a flat surface, such as a floor or bench type seat.
Figure 3:
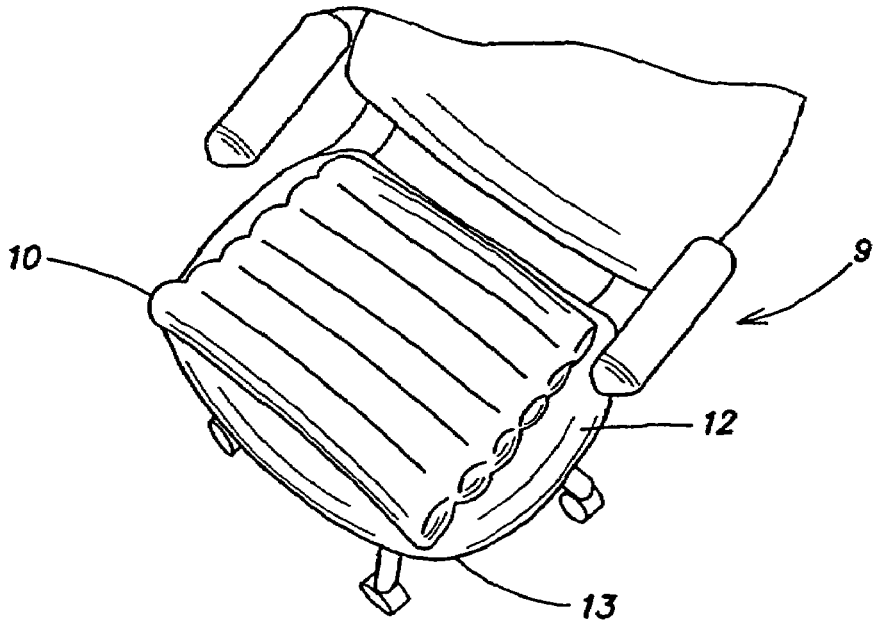
FIG. 3 (PRIOR ART)
FIG. 3 is a top perspective view of the surface comfort device of FIG. 2.

It is to be appreciated that this embodiment of the self-sealing, inflatable support and comfort device comprises a fluid impervious bladder having a cross-section, such as illustrated in FIG. 4. In particular, this embodiment of the fluid impervious bladder 11 has a thickness t of less than 2½ inches. In addition, this embodiment of the fluid impervious bladder 11 such as, for example, a seat cushion comprises a total volume of no more than 0.5 cubic feet of fluid, when fully inflated.

One advantage of the support and comfort device 20 comprising the fluid containing bladder 11, is that the support and comfort device can have the thickness t of less than 2½ inches which may be similar to, for example, the thin foam layer related art devices discussed above, but the surface comfort device will equally spread the pressure from the pressure applying surface 102, such as one sitting on the support and comfort layer, over an even area, thereby eliminating the uncomfortable pressure point that results with the thin foam layer (discussed above). In particular, the bladder 11 compresses and conforms to the pressure applying surface 102 and the underlying surface such as the shaped surface 12 of seat 13. In addition, the bladder provides an equal amount of comfort and pressure along the entire pressure applying surface 102 in contact with the bladder, as illustrated by pressure points 101, 103, 105 and 107 all having substantially equal magnitude of pressure C provided by the bladder. Thus, the inflatable support and comfort device 20 expands the comfort surface area between the body and the body support device, conforms to the shape of the body support device and the pressure applying surface, and eliminates any pressure points that cause discomfort and negatively impact health and wellness.

Referring again to the embodiment 20 of the support and comfort device illustrated in FIGS. 5-6, it is to be appreciated that the support and comfort device 20 may include an inflatable bladder comprising a plurality of parallel tubes 15. For example, the inflatable support and comfort device may be fabricated with tubes formed by sealing, for example by RF welding, one layer of an air-impervious film directly to another opposing layer of air-impervious film with a number of parallel seams 14, thereby forming a plurality of parallel tubes 15. One advantage of this structure is that it can be easily constructed and is inexpensive. The support and comfort device 20 may comprise one or more inflatable bladders formed from at least two layers of air-impervious film, sealed at a perimeter 17 and sealed internally at regular intervals by internal seams 14. Upon inflation, the bladder will comprise a plurality of plural tubes 15 having a generally circular cross-section. It is to be appreciated that the internal seams 14 may be substantially shorter than an overall width w of the bladder to allow for fluid passage between the tubes.

It is also to be appreciated that the support and comfort device, such as the device 20 illustrated in FIGS. 5-6, may comprise the bladder attached to a planar membrane at controlled intervals (not illustrated) to provide additional stability to the bladder. For example, the parallel tube structure can be provided in combination with a material that has a stable length to width ratio, such as illustrated in co-pending U.S. patent application Ser. No. 10/192,757, herein incorporated by reference. An advantage to this embodiment is that the support and comfort device may provide a more uniform and stable cushioning surface.

It is to be appreciated that the support and comfort device may be used with all kinds of conventional body support devices such as, for example, a shaped surface 12 of a seat 13 of a chair 9, for adding comfort to an existing seat, as illustrated in FIGS. 5-6. In addition, the support and comfort device 20 may be used with other shaped body support devices such as, but not limited to, home and office furniture, car seats and any other seating, home or institutional bedding and the like. It is to further be appreciated that the support and comfort device may also be used as a stand-alone comfort device, such as a portable cushion or pillow, and with flat body support devices such as a mattress, a floor and the like. Nevertheless, it is to be understood that one aspect of some embodiments of the support and comfort device is that it is purposely shaped and sized to substantially cover a body support surface such as, a seat chair or seat back, a recliner, or a mattress so that it can be used with the body support device. Accordingly, the support and comfort device may be provided in many shapes and sizes to substantially cover and accommodate a plurality of differently sized and shaped body support devices.

It should also be appreciated that the support and comfort device 20 may be provided and used with additional layers of various materials to improve comfort, support and utility of the support and comfort device such as, for example, a textured or quilted cover layer, can be added for additional comfort, support, protection and the like. In addition, it is to be appreciated that any material, natural or synthetic such as, for example, cotton, down, polyester, foam, including memory foam, a thermoplastic flexible mesh or grid, and any combination of these materials, may be provided with an inflatable device to provide additional comfort and support.

Figure 7:
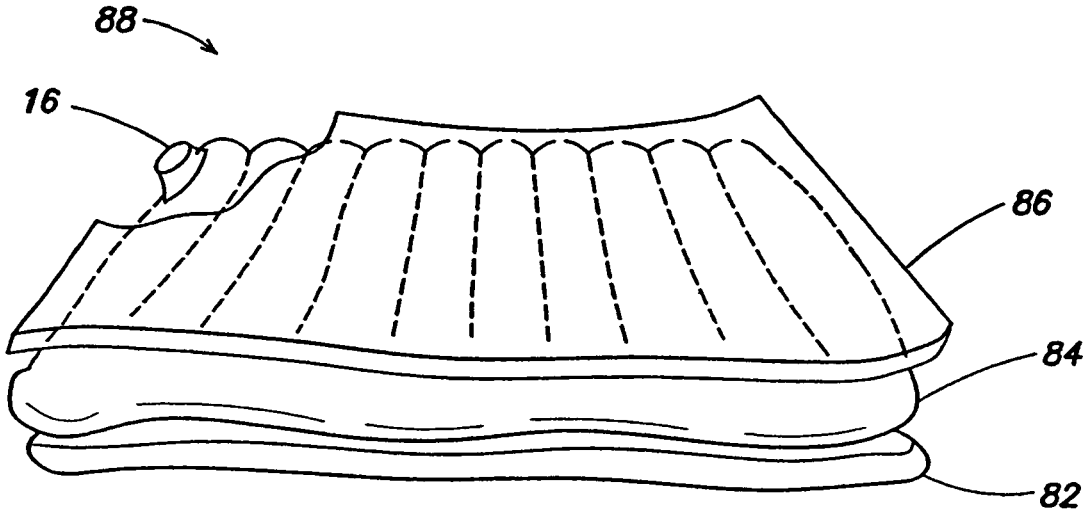
FIG. 7 illustrates another embodiment of a support and comfort device.

For example, referring to FIG. 7 there is illustrated another embodiment 88 of a support and comfort device. According to this embodiment the support and comfort device may comprise a first layer 82, which may be for example a compressible foam or cushioning fabric or any of the other below-described materials. The support and comfort device also comprises a second layer 84, which in one embodiment may be an inflatable bladder 11 of the support and comfort device as described herein. The support and comfort device also comprise a third layer 86, which may be any of the above-described materials such as, for example, a quilted fabric or a synthetic material, which may include a foam or a textured or contoured cushioning material, or may be fabric sewn with a batting, or a quilted material. An exterior covering layer (not illustrated) of, for example, leather, plastic, or a woven material may also be provided to surround and protect these other layers. The support and comfort device, in particular the inflatable bladder, may also include an adjustment device, such as a self-sealing valve 16 to enable rapid inflation and deflation of the bladder, as will be described in further detail herein. It is also to be appreciated that although the self-sealing valve 16 is illustrated as mating with a top layer 86 of the device, it can be provided at any surface of the device.

It is further to be appreciated that support and comfort device may comprise the second and third layers of the device illustrated in FIG. 7, without the first layer. Also, the first layer may be a separate body support device that the support and comfort device is to be used with. The additional layer or third layer may also comprise a fluid retaining structure such as a bladder, or any other structure that is used for providing support and comfort. It is also to be appreciated that the first layer or a combination of the first, second and third layers of the device of FIG. 7, may comprise a body support device such as a chair, a mattress, a recliner, a sofa, and the like, which may include any of, for example, support members, foam, springs, suspension straps, webbing materials, foam or cotton batting, a fabric or a synthetic material, a textured or contoured cushioning material, various quilted materials, and the like. It is to be appreciated that the multilayer support and comfort device, for example as illustrated in FIG. 7, provides additional comfort and support as well as the ability to conform to a shaped body support surface. Moreover, it is to be appreciated that although the embodiment 88 of the support and comfort device illustrated in FIG. 7 is illustrated as a stand alone device, it may also be integrated into an existing body support device or a surface of a body support device.

For example, many body support devices (not illustrated) include a comfort layer hierarchy (not illustrated), including a lower layer, which may have a rigid support member and, for example, any one or more of straps, webbing (either elastic or non-elastic), springs, straps in combinations with springs, or stretched cloth overlaying a frame of the body support device. The comfort layer hierarchy may also include a middle layer, which may be, for example, a foam or cotton batting, and an upper layer which may include a fabric, for example, leather or a synthetic material, etc., over foam or another textured or contoured cushioning material, or may be a fabric sewed with a batting, or one of various quilted materials. It is to be appreciated that the support and comfort device may be integrated anywhere in the support device such as, for example, between the middle layer and the upper layer, or may serve as one of the uppermost layers of such a comfort layer hierarchy, at or near the surface of the body support device and in contact with the body.

Figure 20A:
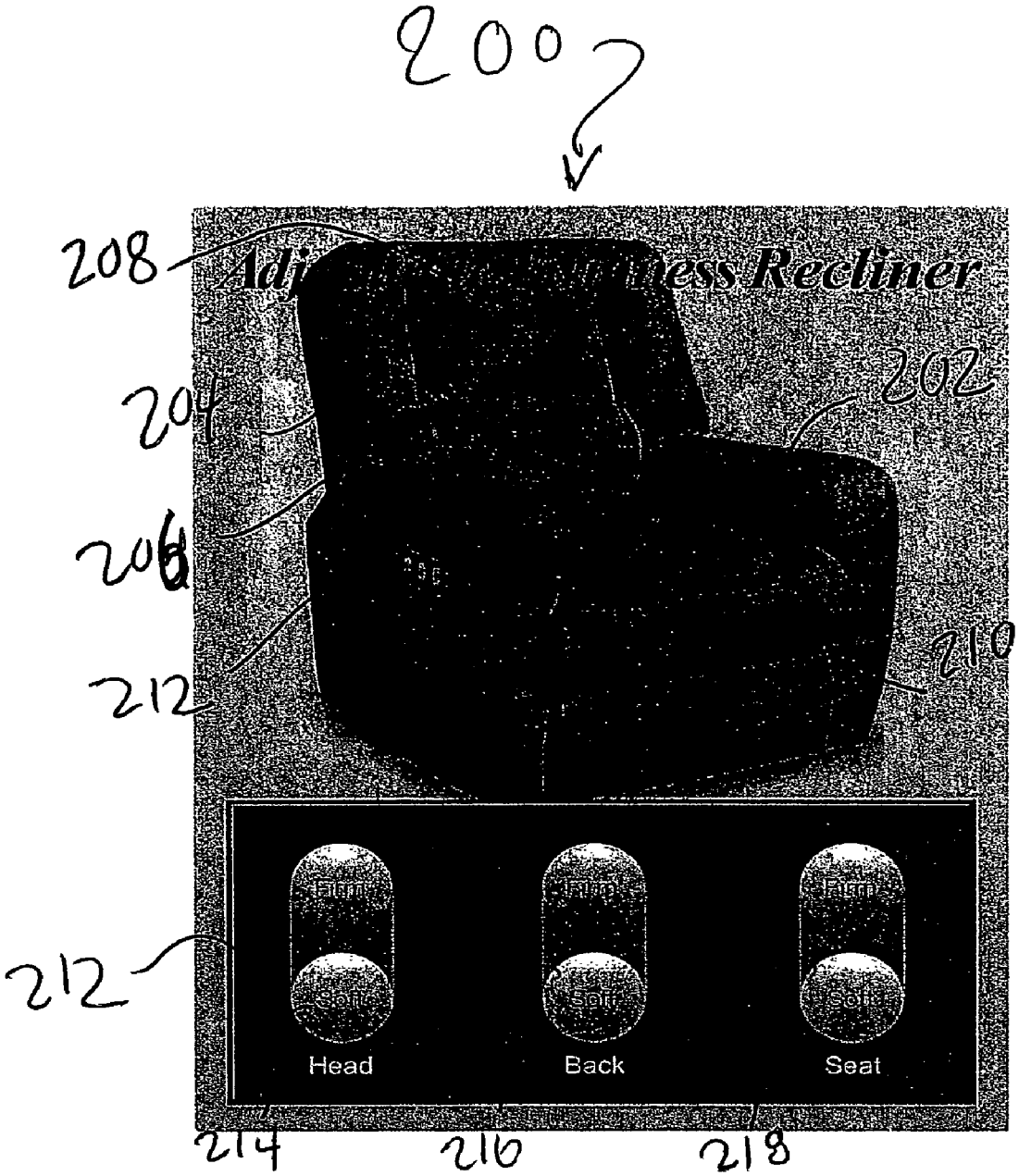
FIG. 20A is a perspective view of another embodiment of a support and comfort device.
Figure 20B:
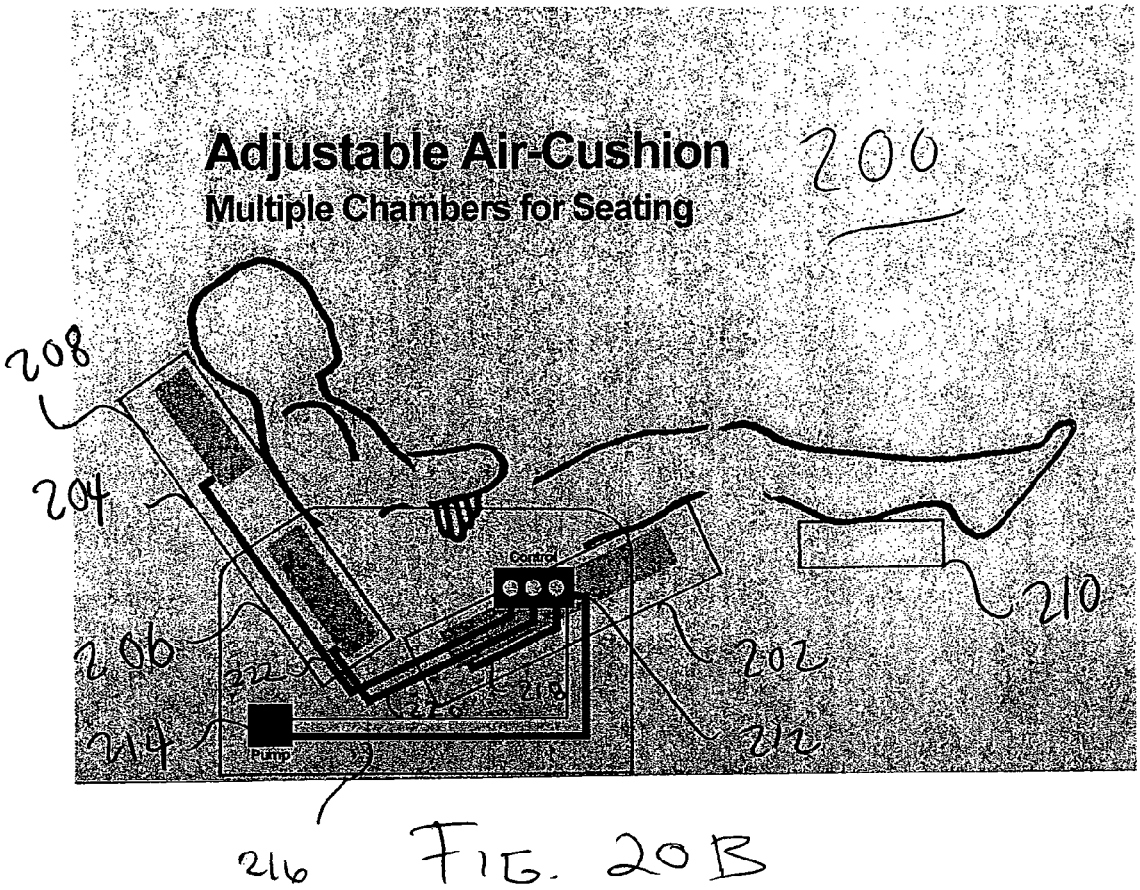
FIG. 20B is a schematic view of the embodiment of the support and comfort device of FIG. 20A.

FIG. 20A is a perspective view of one embodiment of a support and comfort device according to this application, and FIG. 20B is a schematic view of the embodiment of the support and comfort device of FIG. 20A. This embodiment of a support and comfort device comprises a chair, and in particular a reclining chair, that may be provided with a support and comfort device integrated into the chair, for example, in the seat portion 202 of the chair or in the back portion 204 of the chair, to provide an additional support and comfort layer to the chair. Alternatively, a support and comfort device may be provided within each of the seat 202, in a lower portion 206 of the back portion of the chair as a lower back or lumbar support, and in an upper portion 208 of the chair as a neck or head rest support. In addition, the body support and comfort device could also be provided within the foot rest portion 210 of the chair. It is to be appreciated that the body support and comfort device can be provided in any or all of these various parts of the chair according to various aspects of this disclosure.

According to one embodiment of the recliner chair 200 of FIGS. 20A-20B, there is provided a controller for controlling the amount of fluid in any of the body support and comfort devices provided within the chair. In the illustrated embodiment, there are three portions of the controller 214, 216, and 218 for controlling the firmness of the body support and comfort device in the upper portion of the back of chair 208, for controlling the firmness of the body support and comfort device in the lower portion of the back of the chair 206, and for controlling the firmness of the body support and comfort device in the bottom cushion 202 portion of the chair. It is to be appreciated that the controller can also comprises an additional controller to control the firmness of any body support and comfort device provided within the foot rest portion 210 of the chair, or can comprise any variation of these controls to control fewer body support and comfort devices if they are not provided within a chair. In addition, it is to be appreciated that various modifications to the controller such as one controller to control all of these various chambers can also be provided and is contemplated by the disclosure.

This embodiment of the reclining chair can also be provided with a pump 214 (see FIG. 20B) that can provide fluid to the various body support and comfort devices by a fluid conduit 216 from the pump to the controller 212, as well as respective fluid conduits 218, 220 and 222 from the controller 212 to the respective body support and comfort devices in the respective portions of the recliner 202, 206 and 208. It is also to be appreciated that the number and arrangement of the fluid conduits can be modified as is known to those of skill in the art. It is further to be appreciated that this embodiment of the reclining chair can be provided with a valve, such as a self-sealing valve, for example, within the controller 212, to regulate the amount of fluid provided by the pump 214 to the various portions 202, 206 and 208 of the chair 200. It is also to be appreciated that the valve can be any type of valve used in the art, such as a self-sealing valve or a normally biased closed valve, and can be provided at various locations within the chair such as within the controller 212, or at the interface of the fluid conduits 218, 220 and 222 to the body support and comfort devices, or any other arrangement used in the art. Accordingly, it is to be appreciated that for this embodiment of a body support device, one or a plurality of support and comfort devices can be integrated within the body support device.

Figure 8A:
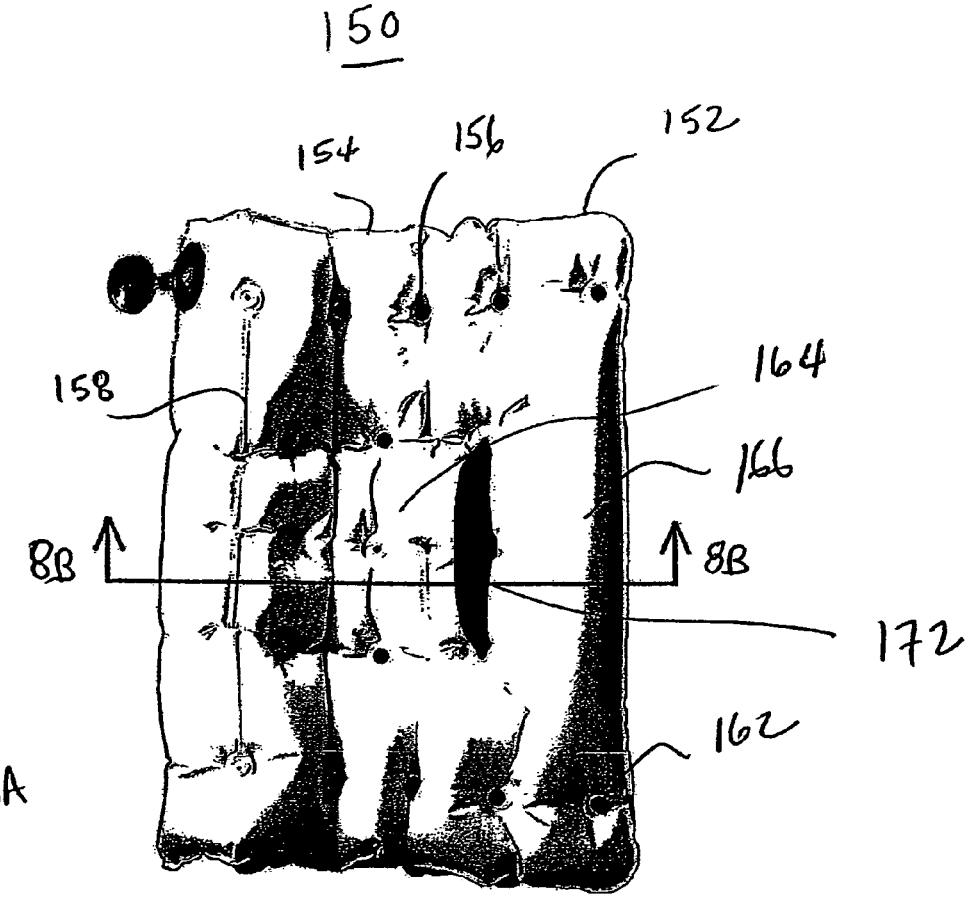
FIG. 8A illustrates a top perspective view of a travel pillow support and comfort device.

It is also to be appreciated that the support and comfort device can be provided separately or with a body support device and intended to be used as an additional support and comfort layer for the body support device. For example, referring to FIG. 8A-8B, there is illustrated a top perspective view and a cross-sectional view, taken along line 8B-8B, of a surface and comfort device 150 that is a sleeping pillow, that can be used as an every night pillow and/or a travel pillow. The sleeping pillow comprises a shaped inflatable bladder 152 that has a contoured shaped 154 to provide comfort and support to a user. The inflatable bladder includes shape defining members such as, for example, RF welds 156 to provide seams 158 and tubes 160 within the bladder, as has been described herein. The shape defining members may also include snaps 162 or straps 161, 163 or other shape defining members such as described in co-pending U.S. patent application Ser. No. 10/192,757. The shape defining members assist with providing the desired shape, contour and profile to the sleeping pillow. The sleeping pillow also comprises a self-sealing valve 16 as described herein, that provides for user adjustability and for rapid inflation and deflation of the sleeping pillow.

Figure 8B:
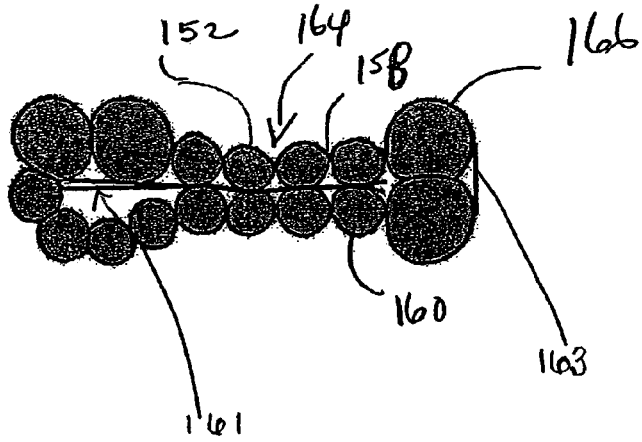
FIG. 8B illustrates a cross-sectional view of the travel pillow of FIG. 8A, taken along lines 8B-8B.
Figure 9A:
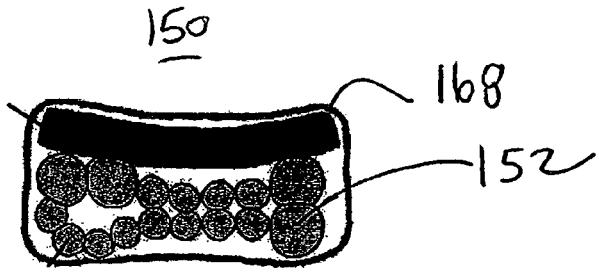
FIG. 9A illustrates a cross-sectional view of another embodiment of a travel pillow support and comfort device.
Figure 9B:
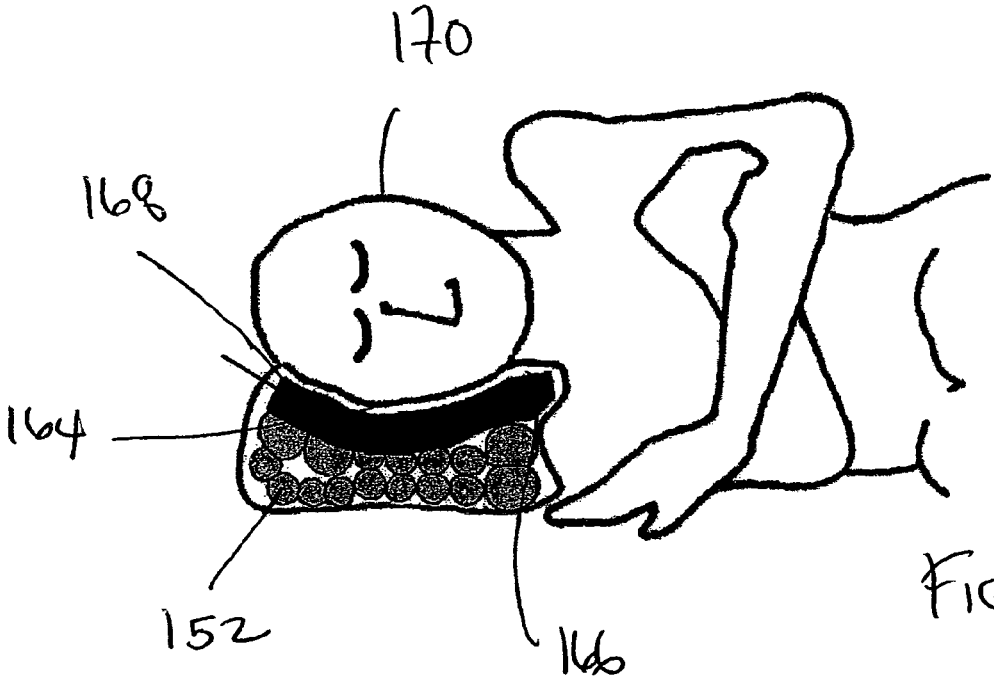
FIG. 9B illustrates the travel pillow support and comfort device of FIG. 9A in exemplary use.

Referring to FIG. 8B, it can be seen that the sleeping pillow has a shape that provides a contoured surface that is more compatible with the profile of a person being supported (See also FIG. 9B illustrating a person 170 using the pillow), which results in increased area of contact between the person 170 and the sleeping pillow. In particular, this pillow has a pocket or recess area 164 for supporting the head of a person using the pillow. The pillow also has an elevated perimeter area 166 that is sized and shaped to extend from the recessed area, to support the neck and top of the head of a user of the pillow, and so that it can be used with a conventional sleeping surface, such as a mattress, or a more rigid surface such as a floor. In particular, the bladder shape and size, in combination with the shape defining membranes, provide a structure that allows for fluid to move from the recessed area to the perimeter area when pressure is applied to the recessed area, for example, by the head of a user. The raised, with respect to the recess, perimeter area supports more elevated, in reference to a horizontal plane, areas of the user of the pillow, such as the neck, thereby expanding the support surface area provided by the pillow (this is illustrated, for example, in FIG. 9B).

One embodiment of the pillow comprises a bladder and an additional layer 168, such as illustrated in cross-section in FIG. 9A and as illustrated in exemplary use in FIG. 9B. In one embodiment, the additional layer is a foam or a memory foam that provides additional comfort and support to the inflatable bladder 152. However, it is to be appreciated that the additional layer may be comprised of any material, natural or synthetic such as, for example, cotton, down, polyester, foam, memory foam, a thermoplastic flexible mesh or grid, or any combination of these materials. In addition, any combination of these materials may be provided with the inflatable bladder to provide additional comfort and support. This embodiment also comprises a strap 172 (See FIG. 8A) that aids in securing the additional layer to the bladder 152. The strap can be attached to the bladder and can connect directly to the additional layer such as, for example, through holes in the additional foam layer.

One embodiment of the travel pillow may be shaped and sized to be similar to a standard size pillow such as, for example, approximately 18" by 22". However, it is to be appreciated that the pillow can be any size including other conventional sizes such as queen and king sized pillows. For example, the pillow may have a smaller size for improved portability. In this embodiment of the pillow, the bladder occupies, for example, a volume of approximately 12" by 16" by 4" and contains anywhere in a range up to approximately ⅓ of a cubic foot of fluid, if fully inflated. However, it is to be appreciated that the volume that the bladder occupies can be anywhere in a range of approximately 20% to approximately 80% of the total volume of the travel pillow or any body support and comfort device described herein. Alternatively, it is to be appreciated that the additional layer may occupy of majority of the volume of the support and comfort device. For example, the additional layer may occupy, in an uncompressed state, up to 80% of the volume of the support and comfort device.

One advantage of this arrangement of the body support and comfort device is that the more contiguous contact surface between the user and the pillow reduces the potential for discomfort associated with excessive localized pressure points that can result when the support surface has only partial contact with the person being supported. Accordingly the pillow device has a more positive impact on the health and comfort of the user than conventional pillow arrangements.

Figure 10:
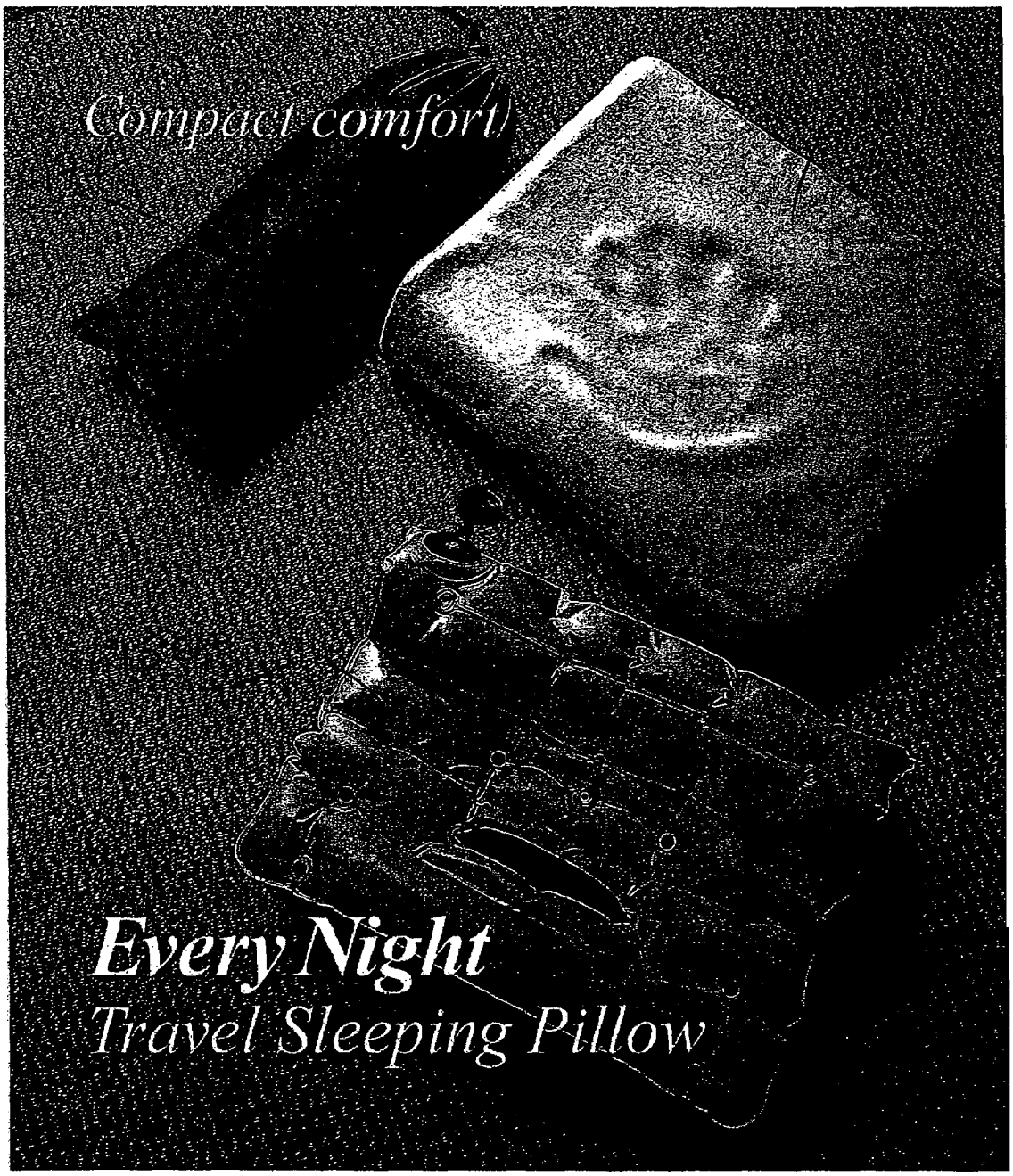
FIG. 10 illustrates a top perspective view of a travel pillow system.

Referring to FIG. 10, there is shown one embodiment of a travel pillow system that includes the travel pillow 150, shown with and without the additional comfort layer of memory foam 168, and a travel bag 172. It can be seen, for example, from FIG. 10 that in addition to the comfort and support provided by the pillow 150 and additional layer 168 that has been described herein, the bladder and additional layer can be deflated and compacted into the travel bag 172. Accordingly, the pillow and additional layer also have the advantage of being made small, lightweight and portable.

Figure 11:
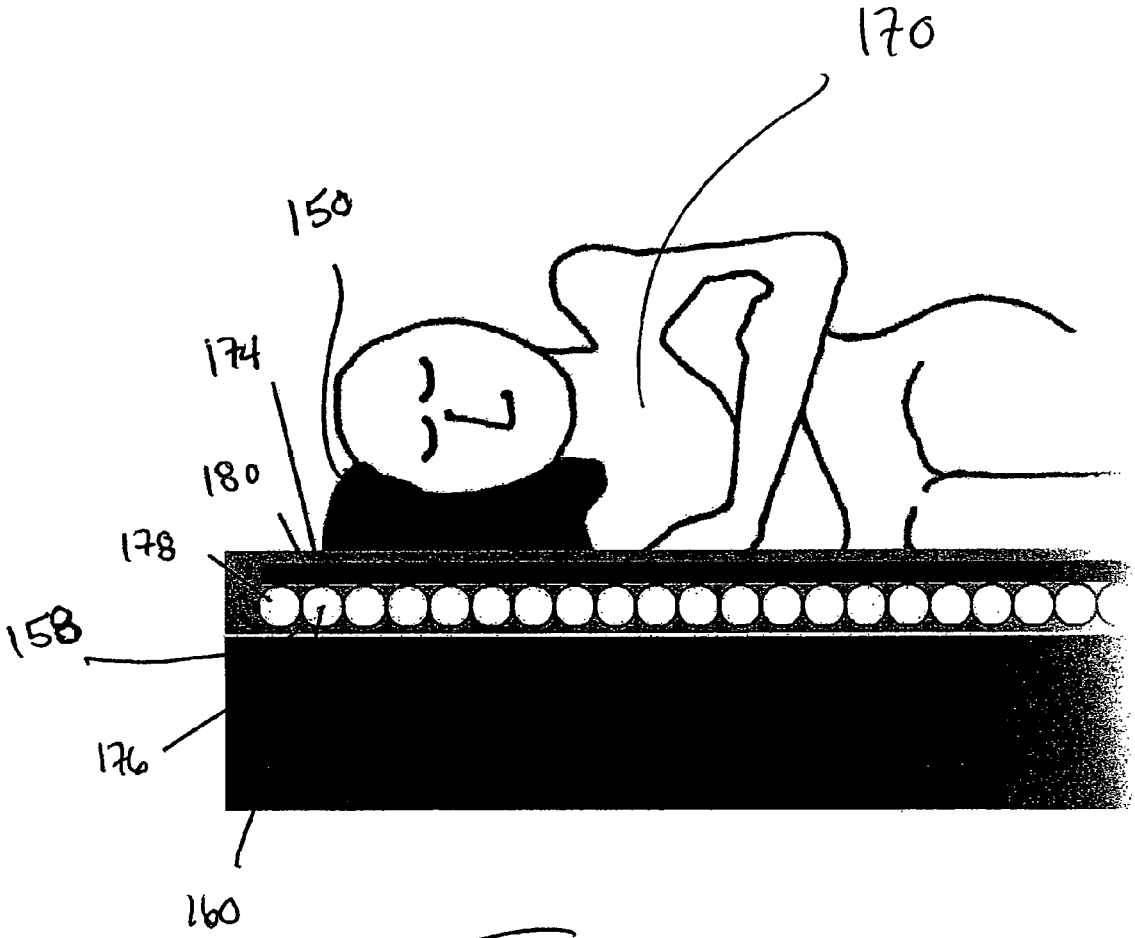
FIG. 11 illustrates a cross sectional view of a mattress topper support and comfort device in exemplary use.

Another embodiment of a body support and comfort device is a mattress topper device 174 which is to be used with a mattress device 176 as illustrated, for example in FIG. 11. It is to be appreciated that the mattress topper support and comfort device can be provided separately from the mattress device or as part of the mattress device, and is intended to be used as an additional support and comfort layer for the mattress device. However, it is also to be appreciated that the mattress topper can be used as a stand-alone device, without an existing mattress base. Accordingly, the mattress topper device can be an every night device and/or a travel device to be used as a stand alone device or with other mattresses.

The mattress topper comprises a shaped inflatable bladder 178 that provides comfort and support to a user. The mattress topper also comprises a self-sealing valve 16 as described herein, that provides for user adjustability and rapid inflation and deflation of the support and comfort device. The shape and size of the mattress topper is configured to integrally mate with a mattress. In addition, the mattress topper provides a surface that is more compatible with the profile of a person being supported, which results in increased area of contact between the person 170 and the mattress topper. It is also to be appreciated that the inflatable bladder can comprise shape defining members such as, for example, RF welds 156 to provide seams 158 and tubes 160 within the bladder, as has been described herein. The shape defining members may also include snaps or other shape defining members such as described in co-pending U.S. patent application Ser. No. 10/192,757. The shape defining members assist with providing the desired shape, contour and profile to the mattress topper. For example, the bladder shape and size, in combination with the shape defining members, provide a structure that allows for fluid to flow throughout the device to provide support and comfort.

Some embodiments of the mattress topper comprise a bladder and an additional layer 180, such as illustrated in exemplary use in FIG. 11. In one embodiment, the additional layer is a foam or a memory foam that provides additional comfort and support to the inflatable bladder 178. However, it is to be appreciated that any material, natural or synthetic such as, for example, cotton, down, polyester, foam, memory foam, a thermoplastic flexible mesh or grid, and any combination of these materials, may be provided with the inflatable bladder to provide additional comfort and support.

One embodiment of the mattress topper may be shaped and sized to be similar to a twin size mattress such as, for example, approximately 39" by 76" by 4". However, it is to be appreciated that the mattress topper can be any size including other conventional sizes such as queen and king sized mattresses. In this embodiment of the mattress topper, the bladder occupies, for example, a volume of approximately 36" by 74" by 1.5" and contains anywhere in a range up to approximately 1.5 cubic feet of fluid, if fully inflated. However, it is to be appreciated that the volume that the bladder occupies can be anywhere in a range of approximately 20% to approximately 80% of the total volume of the mattress topper. Alternatively, it is to be appreciated that the additional layer 180 may occupy of majority of the volume of the support and comfort device. For example, the additional layer may occupy, in an uncompressed state, up to 80% of the volume of the mattress topper device.

One advantage of this arrangement of the body support and comfort device is that a more contiguous contact surface is provided between the user and the mattress topper, which reduces the potential for discomfort associated with excessive localized pressure points that can result when the mattress has only partial contact with the person being supported. Accordingly the mattress topper device has a more positive impact on the health and comfort of the user than conventional mattress arrangements.

It is to be appreciated that these embodiments of the support and comfort device also include the self-sealing valve 16 to enable rapid inflation and deflation of the bladder, as will be described in further detail herein. It is also to be appreciated that although the self-sealing valve 16 is illustrated as mating with a top layer of the device, it can be provided at any surface of the device.

Another advantage of the above described embodiments are that the amount of fluid within the bladder portion of the support and comfort devices can be either rapidly adjusted or adjusted to fine tune the amount of fluid within the inflatable bladder, with the self-sealing valve described herein. This adjustment capability allows the user to adaptively adjust the amount of fluid in the bladder to provide any and all of desired firmness and softness of the support and comfort device, to accommodate various body sizes and types, and to generally improve compatibility of the support and comfort device with a variety of body support devices and environments.

It is to be appreciated that while the support and comfort device is usually inflated with air, any type of fluid, for example, water, nitrogen, or other liquids or gases, may be used to inflate the support and comfort device. To allow for inflation and deflation, the support and comfort device is provided with an adjustment mechanism for any of inflating the support and comfort device, deflating the support and comfort device, or adjusting an amount of fluid within the support and comfort device. For example, one adjustment mechanism might be a manual pump (not illustrated) that, for example, can be manually squeezed to add fluid to the support and comfort device. However, it is to be appreciated that other inflation adjusting mechanisms can also be used, such as an electrically powered pump, or other fluid moving pumps known to those with skill in the art.

In addition, the support and comfort device may also be provided with an adjustment mechanism (not illustrated) to allow for deflation of the support and comfort device. For example, the support and comfort device might be provided with a port having a substantial opening and a cover to seal the port, wherein the cover can be removed to exhaust the fluid from the support and comfort device to deflate the device. It is also to be appreciated that other embodiments of the fluid exhausting devices, as known to those with skill in the art, may also be used with the support and comfort device. It is further to be appreciated that the support and comfort device can also be provided with a fluid adjusting device to adjust an amount of fluid within a device to regulate the comfort and support provided by the support and comfort device. For example, the support and comfort device might be provided with a separate fluid adjusting port and a valve (not illustrated) that allows for exhausting small amounts of fluid to regulate the amount of fluid within the support and comfort device. It should be appreciated that any fluid adjusting device known to those with skill in the art can be used with the support and comfort device. In some embodiments of the support and comfort device, it is desirable to have a fluid adjustment device that is a single mechanism that allows all of inflation, substantial deflation, and adjustment of the amount of fluid in the support and comfort device. For example, the fluid adjusting device may be a valve comprising a spring or other mechanical arrangement known to those in the art, that biases the valve to a normally closed position.

One embodiment of a fluid adjustment mechanism is a self-sealing valve, such as valve 16 illustrated herein and discussed below. Other embodiments of a fluid adjustment mechanism are disclosed in commonly owned, pending U.S. application Ser. No. 10/430,040. The self-sealing valve provides for the firmness/softness of the support and comfort device to be easily adjusted, according to user preference, and without fumbling, for example, with the related art stem valve and its mating or covering structures, as discussed above. An exemplary embodiment of a self-sealing valve 16 will be described in more detail below. However, it is to be appreciated that many self-sealing valve structures, such as disclosed in U.S. Pat. No. 6,237,621 herein incorporated by reference, can be used with the support and comfort device.

The support and comfort device may be provided with fasteners (not illustrated), such as for example, straps, ties, Velcro®, or another type of fastener known to those of skill in the art, to attach the support and comfort device to the body support device. However, it should be appreciated that the support and comfort device need not be provided as a separate device to be used with a body support device, and instead may be integrated into a body support device as one layer for a multi-layered body support device (as discussed above). For example, the chair 200 illustrated in FIGS. 20A-20B may be provided with one or more support and comfort devices integrated into the seat portion 202 of the chair or substantially the entire back portion 204 of the chair, to provide an additional comfort layer. Several support and comfort devices may be used in such a situation. For example, a support and comfort device may be used in each of the seat 202, a lumbar 206 or lower back support, an upper back support, or a neck support, or a headrest 208, a footrest 210, etc. For this embodiment, the self-sealing valve 16 may be adapted such that it also mates with the body support device and may be provided at a convenient location of the chair, such as in the controller 212, so that it can be accessed to inflate or deflate the support and comfort devices. Accordingly, the support and comfort device can be a stand alone device or a device integrated within a body support device.

As stated above, the support and comfort device may include a plurality of substantially parallel tubes 15, as illustrated in FIGS. 5-6. In one embodiment, each tube may have a diameter of approximately 1.5¼ inches, and a center-to-center spacing between adjacent tubes of approximately 1.5½ inches. In this embodiment, the support and comfort device may have a total volume of approximately 0.15 cubic feet of fluid at full inflation. This embodiment of the support and comfort device also includes a self-sealing valve 16 to enable inflation and deflation of the bladder. The firmness of the support and comfort device may be adjusted, by controlling the volume of fluid within the bladder with the self-sealing valve, to provide desired comfort and support. In addition when deflated, the support and comfort device is compactable for easy storage.

Figure 12A:
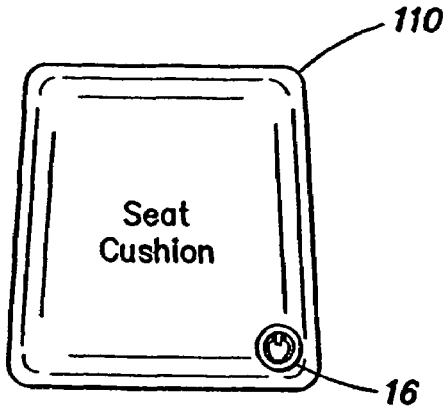
FIGS. 12A-12F are perspective views of other exemplary embodiments of inflatable support and comfort devices.
Figure 12B:
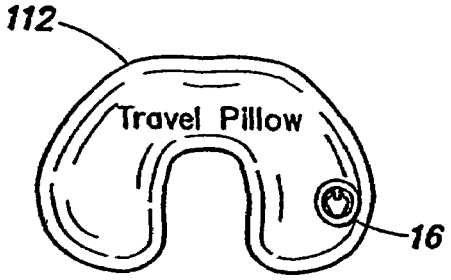
Figure 12C:
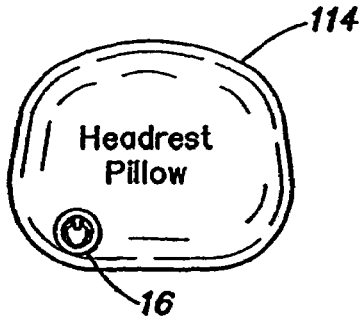
Figure 12D:
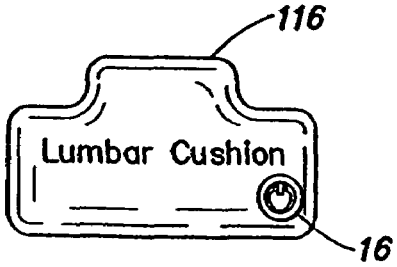
Figure 12E:
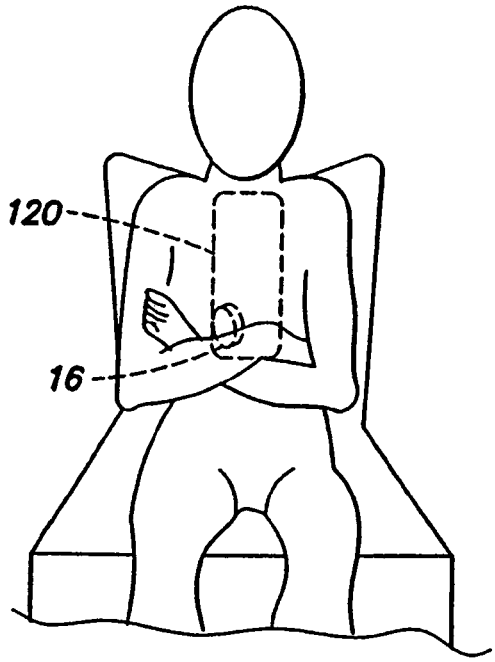
Figure 12F:
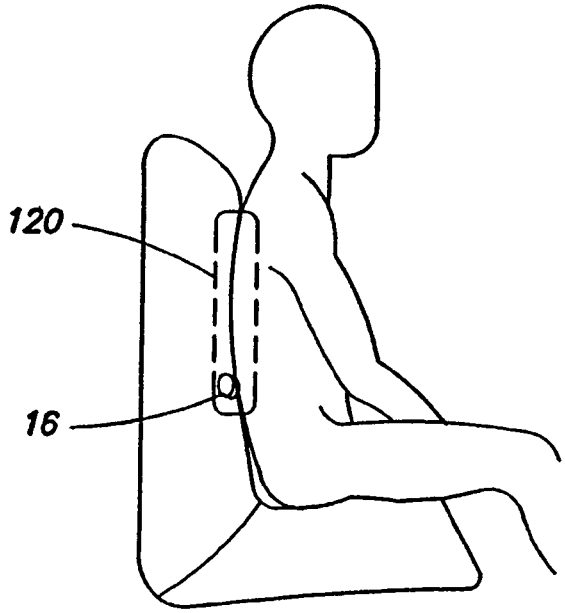
Figure 13A:
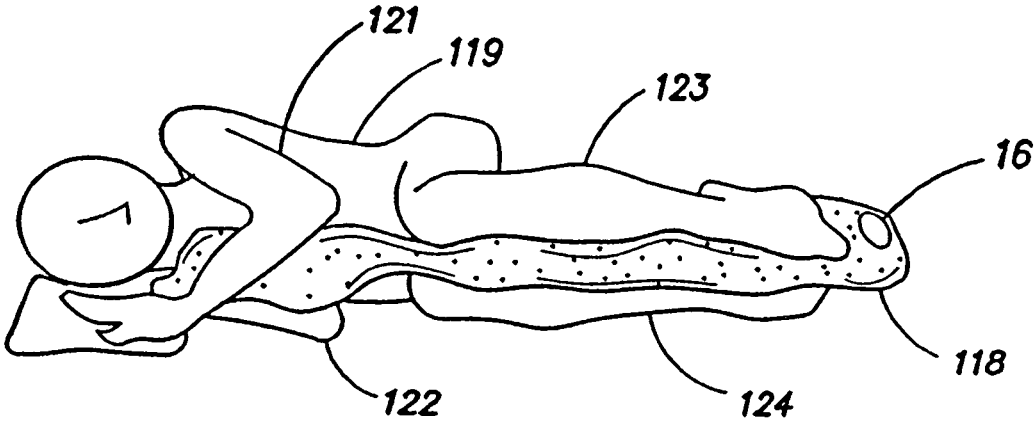
FIGS. 13A-13B illustrate a side view and a top view of an embodiment of a body pillow.
Figure 13B:
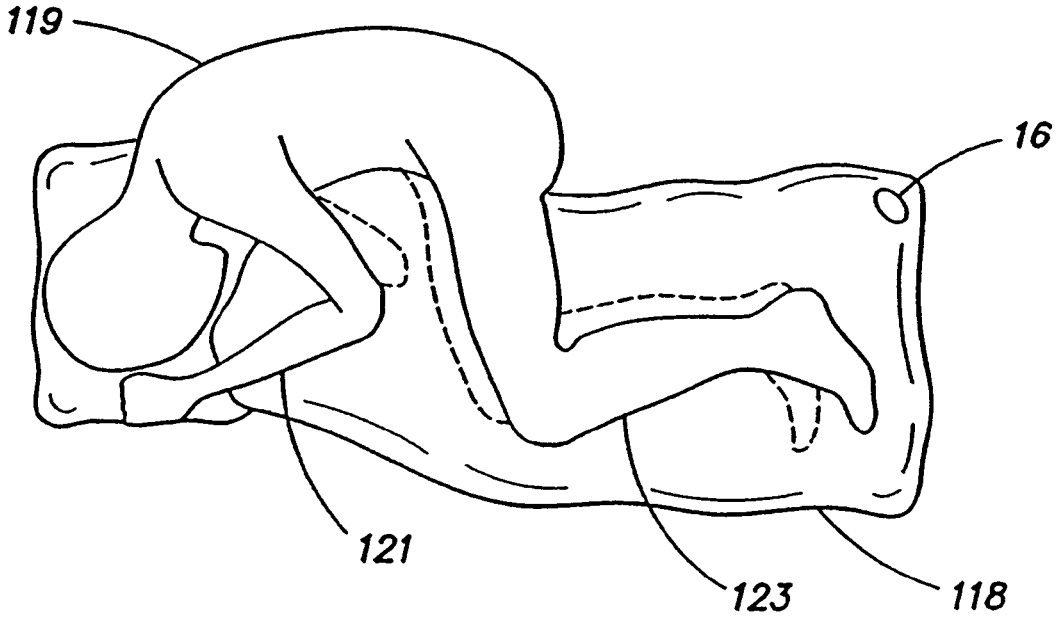
Figure 14:
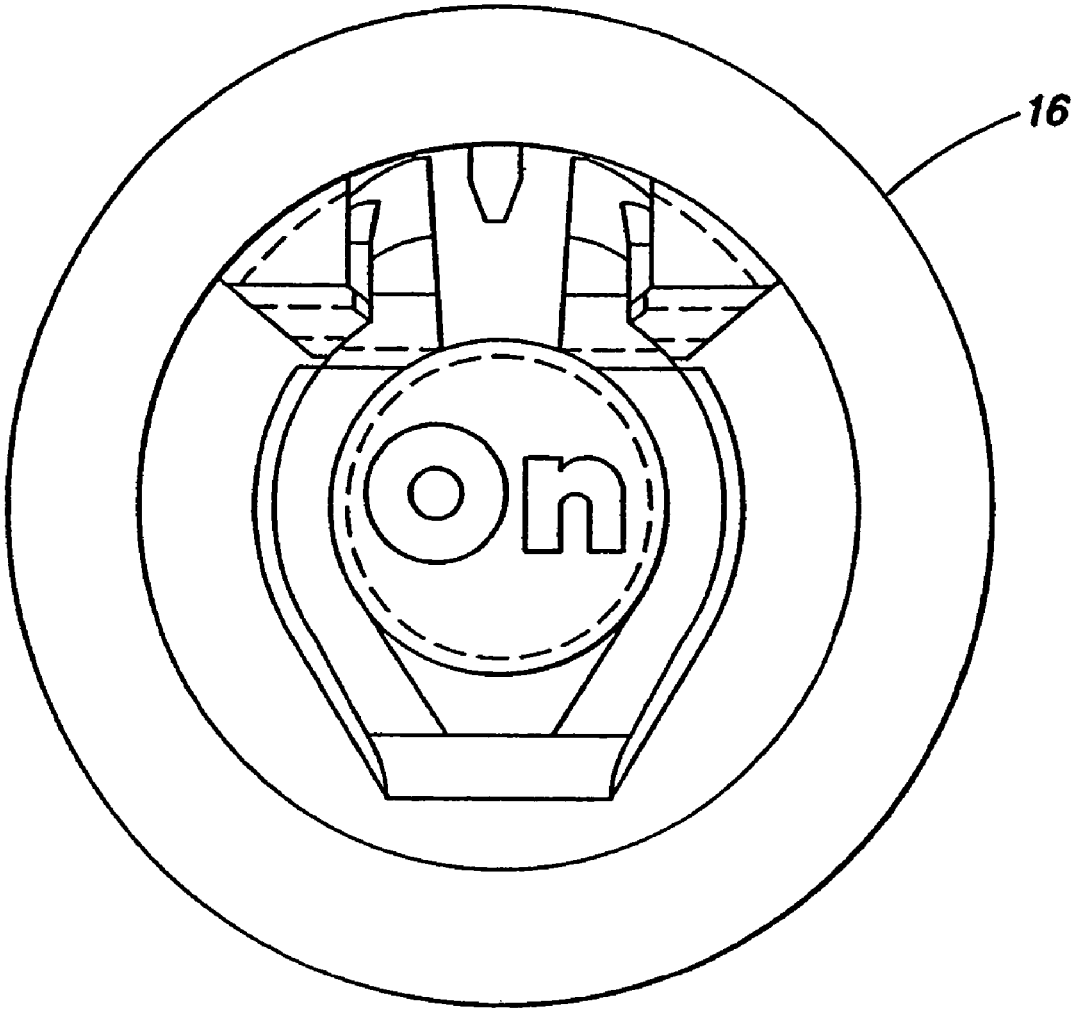
FIG. 14 is an enlarged top view of an embodiment of a self-sealing valve that can be used with various embodiments of the support and comfort device.
Figure 15:
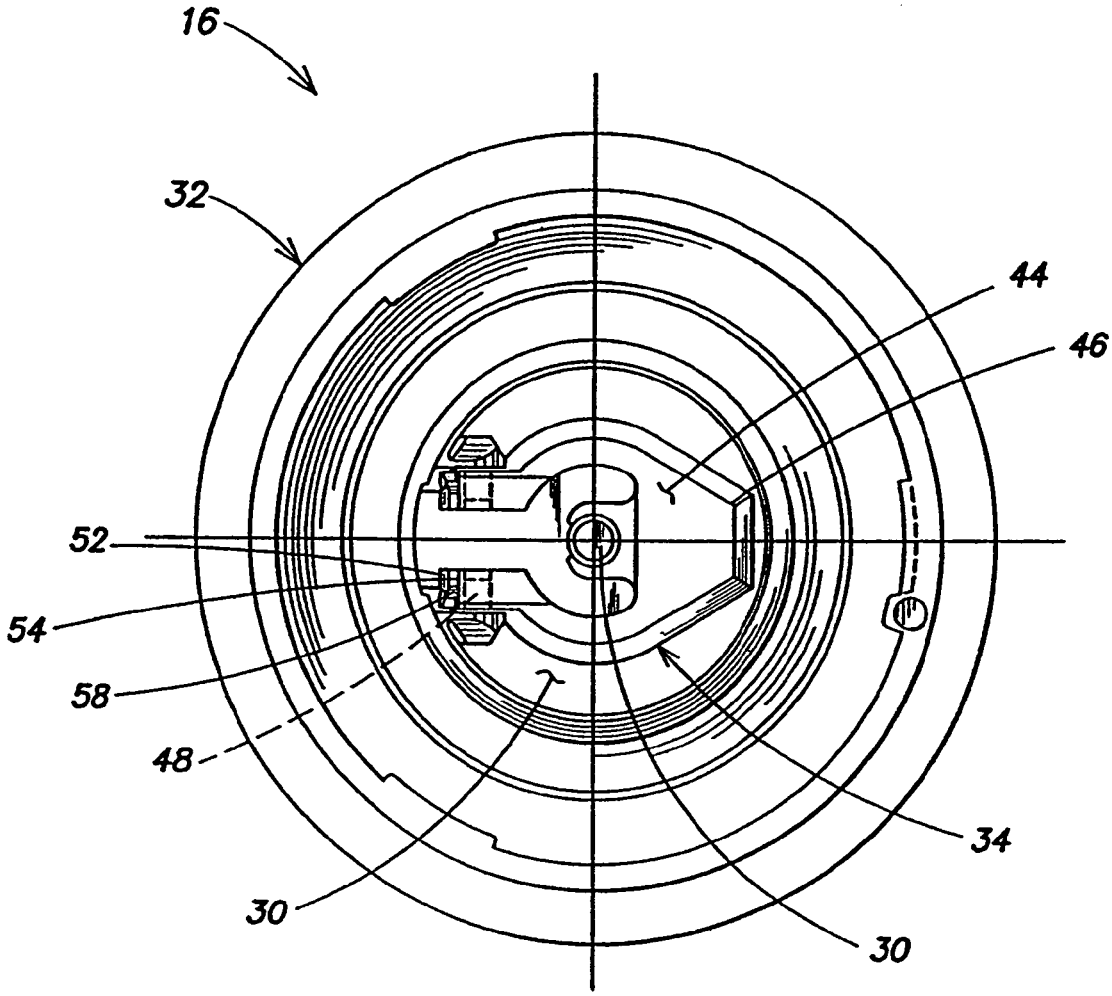
FIG. 15 is a top view of the exemplary embodiment of the self-sealing valve of FIG. 10.
Figure 16:
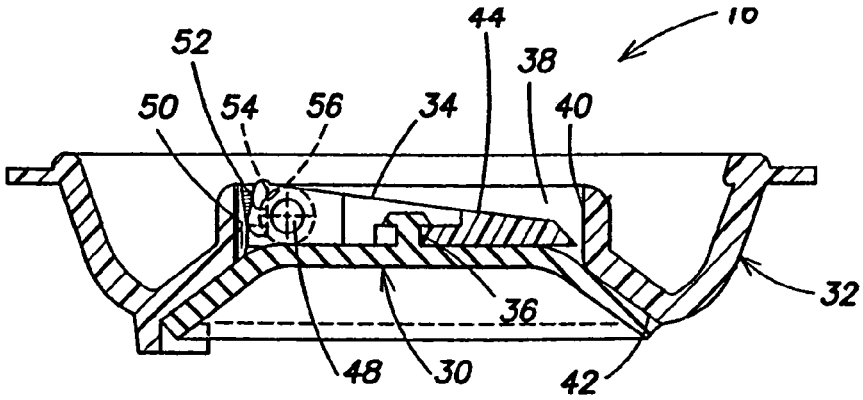
FIGS. 16-18 are cross-sectional side views of the self-sealing valve of FIG. 14.
Figure 17:
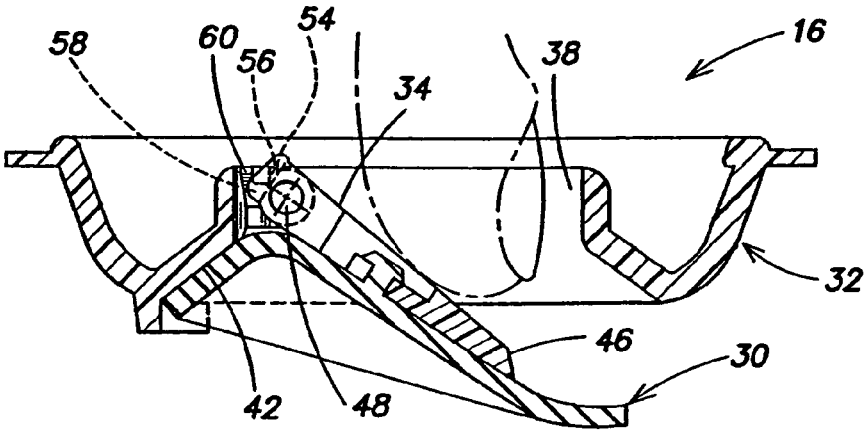
Figure 18:
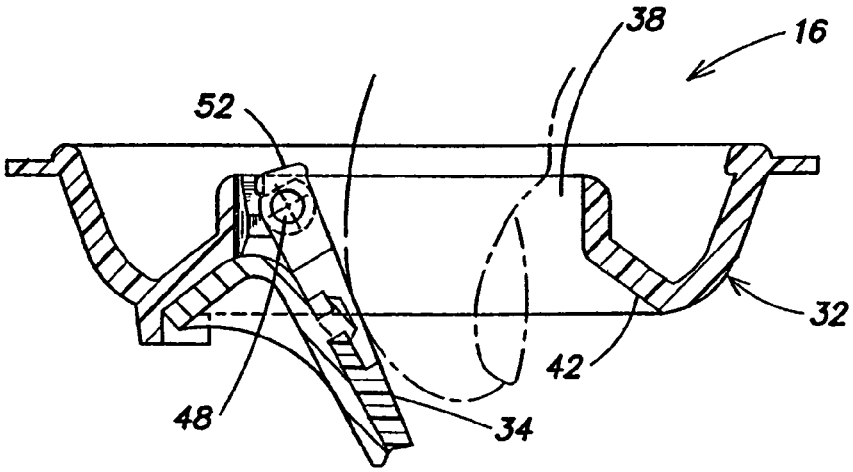

Referring to FIGS. 12A-E, there are illustrated various embodiments of self-sealing, inflatable support and comfort devices. FIG. 12A illustrates one device 110 that is sized and shaped to be used as a seat cushion. It is to be appreciated that the support and comfort device 110 may have a smooth or contoured surface, and includes an inflatable bladder. The support and comfort device 110 also includes a self-sealing valve 16 to allow for manual inflation and deflation of the inflatable bladder. In one example, the device 110 may be a low volume device, having less than approximately 0.2 cubic feet of fluid volume when fully inflated. Other examples of low-volume, support and comfort devices include a travel pillow 112 (FIG. 12B), a headrest pillow 114 (FIG. 12C), a lumbar cushion 116 (FIG. 12D), a back support pillow 120 as illustrated (in phantom) in FIG. 12E, and a body pillow 118 as illustrated in FIGS. 13A-13B. Each of these support and comfort devices 112, 114, 116 and 118 include an inflatable bladder, and a self-sealing valve 16, as illustrated, to enable inflation and deflation, and to also control firmness of the device. Use of these different embodiments of the support and comfort devices as illustrated in FIGS. 12A-12E and 13A-13B should be readily apparent. For example, each of the travel pillow 112 and the head rest pillow 114 can be used as a pillow for example, when traveling on an airplane, in a car, when camping, and the like. In addition, the lumbar cushion 116 can be used for lower back support with a car seat, office chair, with home furniture, and the like. In addition, the back support pillow 120 illustrated in FIG. 8E can be used with a car seat, an office chair and home furniture to provide arch to the back for correct posture and comfort.

Referring to FIGS. 13A-13B, the body pillow 118 can be used, for example, for sleeping on a mattress, when camping, etc . . . to provide comfort, support, and correct posture for sleeping. It is to be appreciated that the volume of fluid within the body support pillow can be varied to accommodate a particular size or shape, for example, of a subject using the body support pillow. It is also to be appreciated that the body support pillow can be used in a number of configurations. For example, the body support pillow may be rolled up into a bolster-like shape to elevate, for example, a lower body of the subject 119. In addition, the body support pillow 118 can be configured to run length wise such that the subject 119 resting on its side can hug the pillow to support the subjects upper-body limbs, providing a layer of cushioning between the upper leg 123 and upper arm 121 that will rest on the body support pillow and the lower leg 124 and lower arm 122 that will rest directly upon, for example, the mattress. It is to be appreciated that as the body support pillow is filled with additional fluid, the body support pillow will further provide cushioning and distance between the upper arm and leg and the lower arm and leg, which can serve both to reduce pressure at points where the upper and lower limbs may come in contact with each other, and provide a more stable body position for sleeping. It is also to be appreciated that the body support pillow also provides improved comfort and well being and improves sleeping posture when used in an appropriate manner. It is further to be appreciated that the body support pillow can be sized and shaped to accommodate a variety of body shapes and sizes. In addition, the body support pillow can comprise one as well as a plurality of inflatable bladders. Further, the body support pillow can be provided with any of a plurality of covering layers and covering layer combinations to provide comfort, temperature control, ventilation and the like. In addition, the body support pillow can be shaped and sized to accommodate a plurality of sleeping positions.

It is to be appreciated that each of these support and comfort devices discussed above with respect to FIGS. 12A-12E and 13A-13B includes a port, coupled to the self-sealing valve 16, for inflation, deflation and comfort control of the support and comfort device through the single port. The self-sealing valve 16 self-opens upon inflation of the device and self-seals upon cessation of inflation. Inflation can be effected for example, by blowing into the valve or using a pump configured to mate with the valve. The self-sealing valve 16 further allows pressure adjustment, as described below. In one embodiment, the single fluid port may have an unobstructed fluid path that is greater than approximately 0.25 inches in diameter. However, it is to be appreciated that the single fluid port may have other diameters to accommodate different support and comfort devices sizes and fluid flow parameters.

Referring to FIGS. 14-18, there is illustrated an exemplary embodiment of a valve 16 that may be used with the various embodiments of a support and comfort device. The self-sealing valve 16 may include a diaphragm 30 positioned within a valve housing 32 by a movable hanger arm 34 which suspends the diaphragm from a mounting point 36 in the center of an air inlet 38. The hanger arm 34 is a rotating diaphragm hanger that is removably contained within the air inlet 38 of the valve housing 32, with one end secured adjacent to an inner wall 40 of the air inlet 38. A point of attachment of the one end of the hanger arm 34 to the inner wall 40 is configured to allow the hanger arm 34 to pivot downward into the valve housing 32, a motion which unseats the diaphragm 30 from a valve seat 42, in a closed position, and opens an airpath, to an open position, into the bladder of the support and comfort layer device to allow for both inflation and deflation of the support and comfort layer device.

According to one example, the hanger arm 34 flares outward towards the inner wall 40 of the air inlet 38 creating a "paddle" surface 44 which overspreads much of the air inlet 38. The paddle surface 44 of the hanger arm 34 provides stability to the flexible diaphragm 30 as it rotates with the hanger arm 34 from the closed position to the open position. The expanded paddle surface 44 of the hanger arm 34 also enhances manipulation of the hanger arm 34 by, for example, a fingertip of a user to, for example, control a firmness of the support and comfort layer device. The paddle surface 44 projects outward to a point 46, extending the length of the hanger arm 34. This projection bears upon the flexible diaphragm 30, thereby preventing it from flexing upward when the hanger arm 34 is pressed downward for firmness control or deflation.

The hanger arm 34 may be secured within the air inlet 38 with a pair of hinge pins 48. In one example, there is a contoured section 50 between the hinge pins 48 of the inner wall of at least one of the brackets and the inner wall 40 of the air inlet 38. The contoured section 50 interfaces with a contoured end 52 of the projecting tabs to provide a plurality of distinct interaction possibilities. A first possibility exists when surface 54 on the projecting tabs bears on surface 56 of the inner wall, restricting rotation of the arm above a horizontal position, thereby securing the valve diaphragm in a substantially closed position.

A second possibility exists when a beveled surface 58 on the projecting tab bears on counter-beveled surface 60 on the wall. An inclined angel of this counter-beveled surface 60 causes the projecting tab to increasingly compress inward as the hanger arm 34 is pressed downward into the valve housing 32. This may occur both during inflation (by air pressure) and deflation (by manual deflection of the hanger arm to unseat the valve from the valve seat). The compression of the projecting tab also results in a counter action, so that, with removal of the downward pressure the tab "springs back to its original position and forces the hanger arm 34 and diaphragm 30 to return to the closed position. When the hanger arm 34 is depressed fully, the projecting tabs rotate slightly beyond the beveled surface 60 and lock the rotating arm in a locked open position. This locked open position maximizes airflow through the valve housing and will, under certain conditions improve efficiency of both inflation and deflation. These and other exemplary embodiments of the valve 16 are described in more detail in U.S. Pat. No. 6,237,621, which is herein incorporated by reference.

Figure 19:
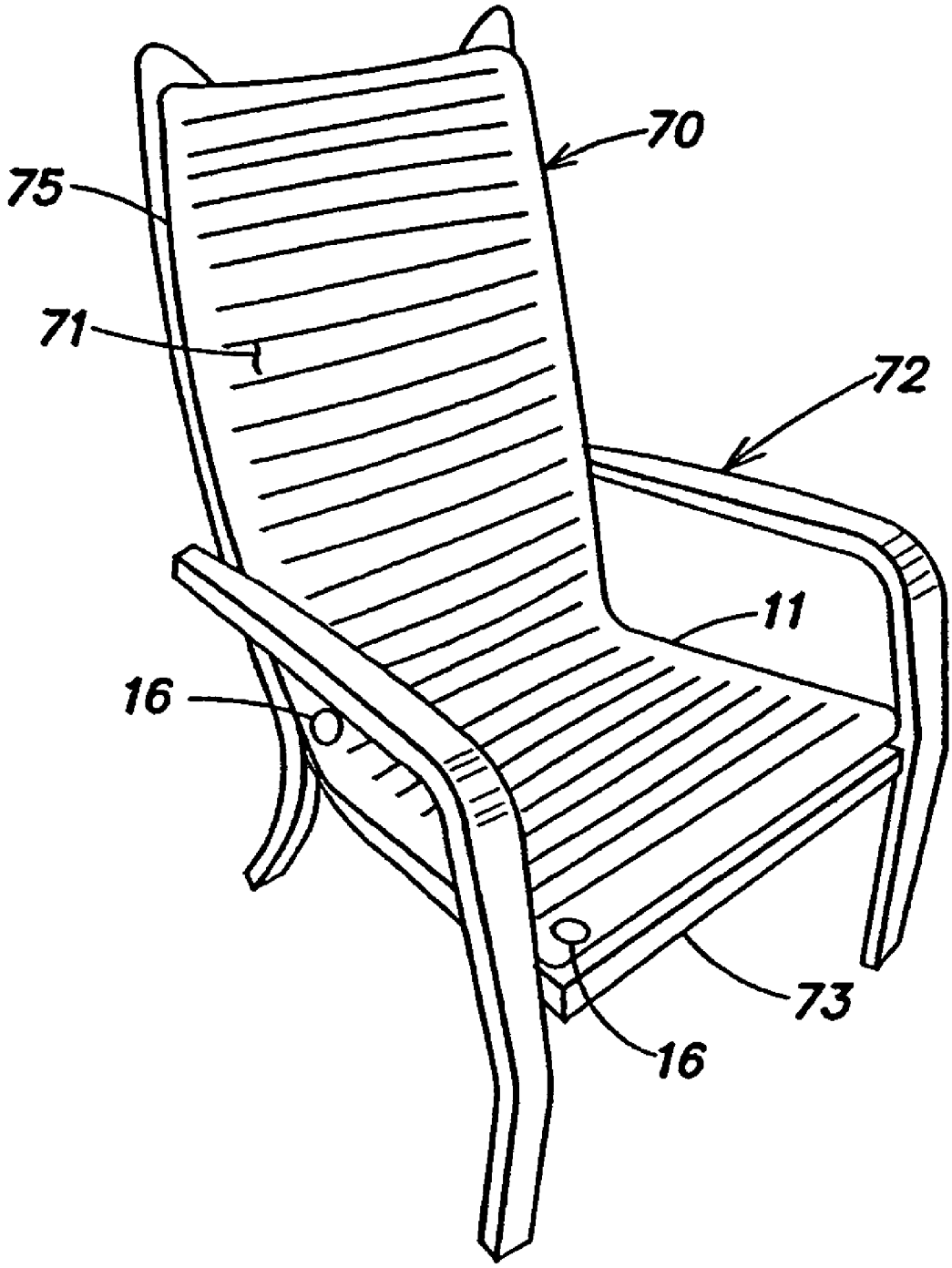
FIG. 19 is a perspective view of another embodiment of a support and comfort device.

Referring now to FIG. 19, there is illustrated another embodiment of a support and comfort device 70 adapted to be used as a comfort layer for covering substantially all of a seat and seat back of a chair 72. It is to be appreciated that this embodiment of the support and comfort device 70 may comprise more than one fluid impermeable bladder, such as for example, two fluid impermeable bladders 11 and 71, one for substantially covering and conforming to the seat cushion 73 and one for substantially covering and conforming to the seat back 75. It is also to be appreciated that this embodiment of the support and comfort device 70 may be provided with either a single valve 16, or multiple self-sealing valves 16, such as one for each fluid impermeable bladder, to allow for variable firmness in any of the seat and seat back portions of the support and comfort device 70.

It is to be appreciated, in general, that in some applications, it is desirable that the support and comfort device overspread as much as possible of a body support device with which the support and comfort device is to be used. Therefore, the support and comfort device may be provided in a number of different shapes and sizes, adapted to be used with a number of different sized and shaped body support devices, to accommodate different sized chairs, bedding, office and home furniture, etc. In addition, the support and comfort device may be provided with at least one or more additional cover layers, for example, a quilted or textured layer, to enhance comfort, to provide a protective layer, to reduce noise, and the like. In one embodiment, a variety of attachable cover layers may be provided with the support and comfort device. It is further to be appreciated that an outer layer of the support and comfort device may further be provided in a variety of different colors.

Having thus described various illustrative non-limiting embodiments, and aspects thereof, modifications and alterations will be apparent to those who have skill in the art. Such modifications and alterations are intended to be included in this disclosure, which is for the purpose of illustration and explanation, and not intended to define the limits. The scope should be determined from proper construction of the appended claims and their equivalents.

What is claimed is:

1. A body support and comfort device having a desired contour and profile of a surface that is to interact with a user, the body support and comfort device comprising:

an inflatable bladder including a plurality of chambers that are fluidly connected to one another, the plurality of chambers sized and arranged to provide the desired contour and profile;

an additional comfort layer shaped and arranged to substantially cover the surface of the inflatable bladder that is to interact with the user;

a first chamber and a second chamber of the plurality of chambers defined at least partly by a first shape-defining member; and a second shape-defining member that spans from the first chamber to the second chamber, wherein the first shape-defining member and the second shape-defining member in combination with the inflatable bladder define a recessed area in the desired contour and profile of the surface that is to interact with the user, and wherein the first shape defining member and the second shape-defining member are configured to substantially maintain the desired contour and profile when pressure is applied to the surface by the user.

2. The body support and comfort device as claimed in claim 1, wherein a thickness of the inflatable bladder comprises not more than 80% of the total thickness of the body support and comfort device when the device is in a fully inflated, uncompressed state.

3. The body support and comfort device as claimed in claim 1, wherein a thickness of the additional comfort layer comprises not more than 80% of the total thickness of the body support and comfort device when the device is in a fully inflated, uncompressed state.

4. The body support and comfort device as claimed in claim 1, wherein the inflatable bladder comprises a port through which inflation and deflation of the inflatable bladder is accomplished; and a valve coupled to the port of the inflatable bladder that is constructed and arranged to enable all of inflation, deflation, and comfort control of the support and comfort device with the valve.

5. The body support and comfort device as claimed in claim 4, wherein the valve is a self sealing valve.

6. The body support and comfort device as claimed in claim 1, wherein the additional comfort layer comprises foam.

7. The body support and comfort device as claimed in claim 6, wherein the foam is a memory foam.

8. The body support and comfort device as claimed in claim 1, wherein the inflatable bladder is shaped and arranged to be used as a pillow to provide comfort and support to a head of the user.

9. The body support and comfort device as claimed in claim 8, wherein the bladder comprises an inflated thickness of not more than approximately 6 inches.

10. The body support and comfort device as claimed in claim 8, wherein the bladder has an area of approximately 12 inches×16 inches.

11. The body support and comfort device as claimed in claim 8, wherein the recessed area is configured to support the head of the user.

12. The body support and comfort device as claimed in claim 11, wherein the pillow shape comprises a perimeter area that is larger in cross section than the recessed area, and that is configured to provide support to a neck area of the user.

13. The body support and comfort device as claimed in claim 1, further comprising an attachment that secures the additional comfort layer to the inflatable bladder.

14. The body support and comfort device as claimed in claim 1, wherein the device is shaped and sized to be used on top of a mattress to provide comfort and support to the user.

15. The body support and comfort device of claim 14, wherein the bladder has an inflated thickness of not more than approximately 2.5 inches.

16. The body support and comfort device of claim 5, wherein the self-sealing valve is adapted to enable adjustment of a pressure of a fluid within the inflatable bladder by manually pressing a portion of a diaphragm of the self-sealing valve.

17. The body support and comfort device of claim 1, wherein the inflatable bladder comprises a total volume of no more than substantially 2 cubic feet of fluid when fully inflated.

18. The surface body support and comfort device of claim 17, wherein the inflatable bladder comprises a total volume of no more than 0.5 cubic feet of fluid when fully inflated.

19. The body support and comfort device of claim 1, wherein the inflatable bladder comprises a plurality of tubes.

20. The body support and comfort device of claim 1, wherein the additional layer comprises a second inflatable bladder.

21. The body support and comfort device of claim 1, wherein the second shape-defining member spans between the first chamber and the second chamber in a direction that is substantially perpendicular to the surface.

22. The body support and comfort device of claim 21, wherein the second shape-defining member is a strap.

23. The body support and comfort device of claim 1, further comprising a cover configured to cover the inflatable bladder and the additional comfort layer.

24. The body support and comfort device of claim 1, wherein the first chamber has a first height when inflated, wherein the second chamber has a second height when inflated, and wherein the first height is greater than the second height.

25. The body support and comfort device of claim 24, wherein the inflatable bladder is shaped and arranged to be used as a pillow, wherein the first chamber is included in a perimeter area of the inflatable bladder, and wherein the second chamber is included in the recessed area.

26. The body support and comfort device of claim 25, wherein the desired contour and profile includes a raised perimeter on two sides of the recessed area.

27. The body support and comfort device of claim 1, wherein the second shape-defining member includes a strap.

28. The body support and comfort device of claim 27, wherein the first chamber includes a tubular shape and the second chamber includes a tubular shape.

29. The body support and comfort device of claim 1, further comprising a third shape defining member.

30. The body support and comfort device of claim 29, wherein the third shape-defining member includes a snap coupled to the second shape-defining member.

31. The body support and comfort device of claim 1, wherein the second shape-defining member spans from the first chamber to the second chamber external to each of the first chamber and the second chamber.

32. The body support and comfort device of claim 1, wherein the recessed area is configured to support a head of the user.

33. The body support and comfort device of claim 32, wherein a first perimeter area larger in cross section than the recessed area is located on a first side of the recessed area, and wherein a second perimeter area larger in cross section than the recessed area is located on a second side of the recessed area.

34. A pillow having a desired contour and profile of a surface that is to interact with a user, the pillow comprising:

an inflatable bladder including a plurality of chambers that are fluidly connected to one another, the plurality of chambers sized and arranged to provide the desired contour and profile;

an additional comfort layer shaped and arranged to substantially cover the surface of the inflatable bladder that is to interact with the user;

the plurality of chambers including a first tubular-shaped chamber having a first diameter and a second tubular-shaped chamber having a second diameter defined at least partly by a first shape-defining member; and a second shape-defining member that spans from the first tubular-shaped chamber to the second tubular-shaped chamber, wherein the plurality of chambers and the first and second shape-defining members provide the desired contour and profile of the surface that includes a recessed area, and wherein the second shape-defining member is configured to substantially maintain the desired contour and profile of the surface when pressure is applied to the surface by the user.

35. The pillow of claim 34, wherein the first diameter is greater than the second diameter.

36. The pillow of claim 35, wherein the second shape-defining member includes a strap.

37. The pillow of claim 36, further comprising a third shape defining member that includes a snap.

38. The pillow of claim 34, wherein the desired contour and profile includes a raised perimeter on two sides of the recessed area, wherein the first tubular-shaped chamber is located in the raised perimeter, and wherein the second tubular-shaped member is located in the recessed area.

39. The pillow of claim 38, wherein the second shape-defining member spans from the first tubular-shaped chamber to the second tubular-shaped chamber external to each of the first and the second tubular-shaped chambers.

40. The pillow of claim 38, wherein the inflatable bladder is configured to allow for fluid to move from the recessed area to the raised perimeter when pressure is applied to the recessed area.

* * * * *